US005947308A

United States Patent [19]

Markelz

[11] Patent Number: 5,947,308

[45] **Date of Patent: *Sep. 7, 1999**

[54] BRIDGE ERECTION SYSTEM

[76] Inventor: Paul H. Markelz, 28W 231 Oak Creek Dr., West Chicago, Ill. 60185

[ * ] Notice: This patent is subject to a terminal disclaimer.

[21] Appl. No.: 09/246,464

[22] Filed: Feb. 9, 1999

Related U.S. Application Data

[63] Continuation-in-part of application No. 08/887,747, Jul. 3, 1997.

[51] Int. Cl.[6] ..... E01B 29/02

[52] U.S. Cl. ..... 212/294; 212/312; 104/2

[58] Field of Search ..... 212/312, 294, 212/344, 345; 414/459, 460, 461; 104/2, 3

[56] References Cited

U.S. PATENT DOCUMENTS 4,216,264 8/1980 Theurer et al. ..... 104/2
4,275,659 6/1981 Theurer et al. ..... 104/2
4,566,389 1/1986 Theurer et al. ..... 104/3
5,595,313 1/1997 Kroll et al. ..... 212/225
5,762,464 6/1998 Hertelendi ..... 104/2
5,778,795 7/1998 Kusel et al. ..... 212/325

*Primary Examiner*—Thomas J. Brahan
*Attorney, Agent, or Firm*—Quarles & Brady, LLP

[57] ABSTRACT

A mobile crane including a wheeled carriage, support members having distal ends, mounted to the carriage and extendable laterally therefrom in two positions including a retracted position with the distal ends adjacent the carriage and an extended position with the distal ends separated from the carriage, first and second glide beams coupled to the distal ends for movement along a movement axis perpendicular thereto, at least one support beam connected to the tops of the glide beams and a hoist trolley coupled to the support beam. The components operate together to provide a fully supported gantry crane having a variable width useful in lifting and transporting various items including items which are wider than the carriage.

43 Claims, 15 Drawing Sheets

FIG. 27
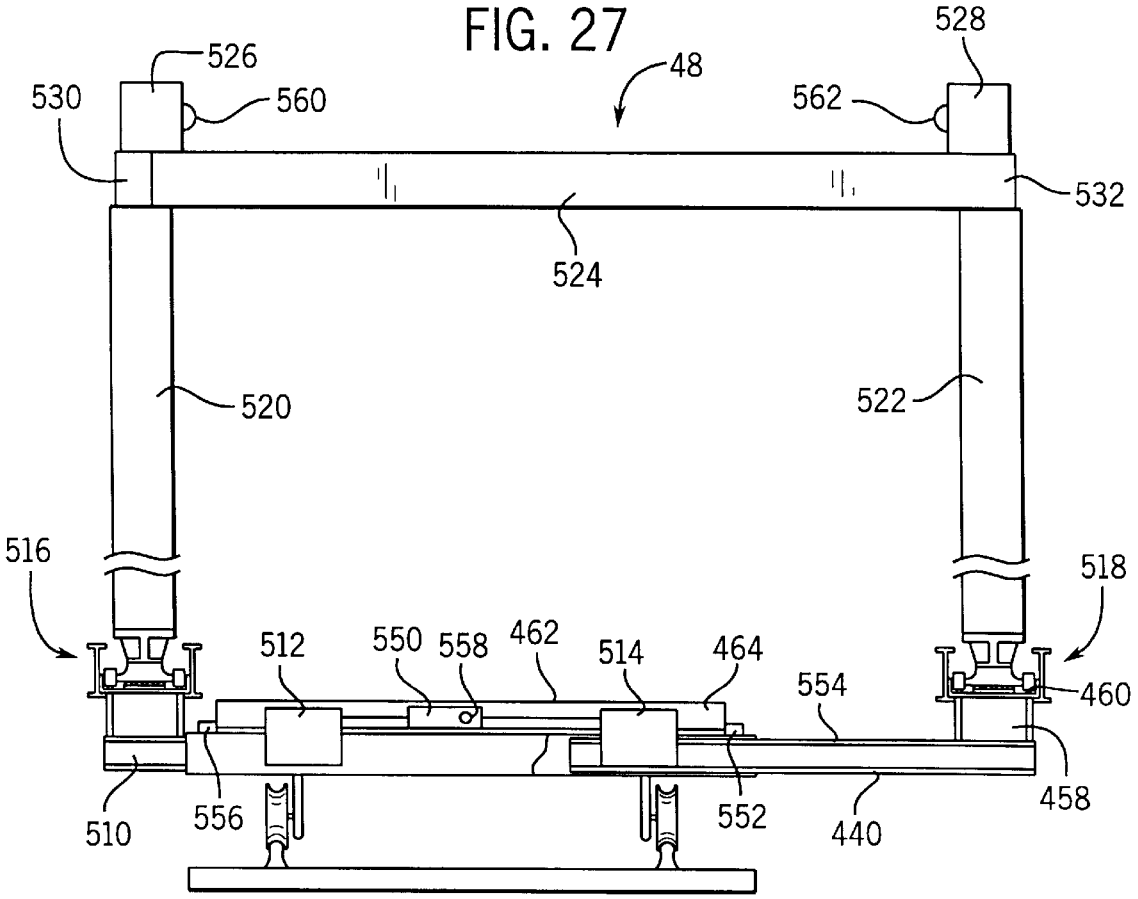
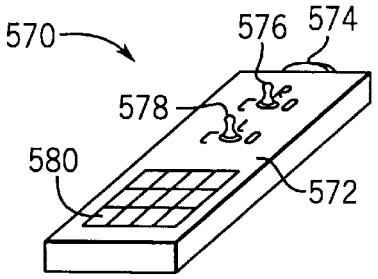
FIG. 28
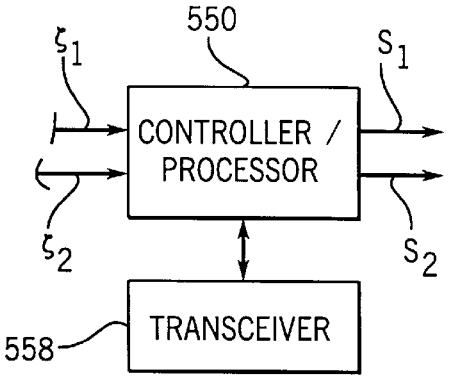
FIG. 29

BRIDGE ERECTION SYSTEM

CROSS-REFERENCE TO RELATED APPLICATIONS

This is a continuation-in-part of U.S. patent application Ser. No. 08/887,747, filed on Jul. 3, 1997, and entitled, "Bridge Erection System."

BACKGROUND OF THE INVENTION

The present invention relates to an apparatus for assembling elevated structures and more particularly to a portable gantry crane apparatus which is useful in erecting and disassembling railroad bridges.

One commonly used type of crane system is known as a gantry crane. Referring to FIG. 1, a gantry crane 10 includes a plurality of vertical main support members 12, two main girders 14, a trolley girder 16 including parallel tracks 18 on its top surface and at least one trolley 20. The support members 12 support the main girders 14 which in turn support the trolley girder 16. Tracks 22 are also included on the upper surface of the main girders 14 so that the trolley girder 16 can move in either direction parallel to the main girders 14. The trolley 20 is fitted with wheels 24 so that it can move on tracks 18 parallel to the length of the trolley girder 16. A cable 26 extends down from a hoist on the trolley 20 and includes a block and tackle hook 28 at its lower distal end.

In operation, the trolley girder 16 can be moved on the tracks 22 so as to be above any area between the main girders 14. The trolley 20 can be moved so as to be anywhere along the length of the trolley girder 16. The hoist raises and lowers the cable 26 vertically displacing materials or equipment attached to the hook 28.

Gantry cranes are considered relatively safe for a number of reasons. For example, because the trolley girder 16 is supported by a plurality of support members and at least two main girders 14, load forces are distributed among a number of different girders and support members as opposed to a single boom. In addition, assuming that the maximum system load is not surpassed, there is little chance that gantry crane components will be driven into an unstable configuration where the load and system will be unbalanced. Furthermore, because the area between the main girders is free of obstruction, there is little chance that the trolley girder 16, the primary moving component of a gantry crane, will collide with other equipment.

While gantry cranes have many advantages, they are generally not suitable for on-site construction jobs. U.S. Pat. No. 4,497,153 describes one on-site gantry system which illustrates various problems that make on-site gantry systems impractical. The system includes two hoists positioned on, and movable along separate main girders. The hoists cooperate to move prefabricated beams laterally within the area defined by the main girders. The system, as is typical with all gantry systems, requires a complex configuration of support members and girders. Therefore, it is relatively expensive, difficult to transport, and requires a detailed and time consuming setup and takedown protocol.

In addition, the system is immobile after assembly. Thus, once assembled, the system can only transport equipment and materials within the area defined by the main girders. In order to use the system in another area, it must be disassembled, moved, and reassembled in the other area. These problems have generally limited gantry crane use to permanent operating areas or to small on-site areas.

Another common type of crane system is the mobile level-luffing crane. Referring to FIG. 2, a mobile crane 30 generally includes a carriage 32, a rotating machinery deck 33, operational machinery 34 supported on the deck 33, a hinged boom 36 attached to the machinery deck 33, a first set of topping lines 38, a second set of topping lines 42, and a hook block and tackle 40. The boom 36 is pivotally secured to the machinery deck 33 and operated by increasing and decreasing the length of the first set of topping lines 38. The second set of topping lines 42 is used to raise and lower the hook 40. The carriage 32 and deck 33 are ballasted, thereby adding stability to the crane when loaded.

In FIG. 2, the mobile crane 30 is a locomotive type, being self propelled and fitted with two railroad trucks 44. Power machinery to operate the mobile crane 30 is deck mounted, and the machinery deck is normally completely housed.

The mobile crane 30 overcomes many of the problems associated with a gantry system. For example, many mobile cranes are self propelled and can easily be moved to, and used at, on-site construction locations. In addition, it is not necessary to dismantle a mobile crane in order to move it around a construction site. In fact, often it is not necessary to dismantle a mobile crane to move it from one construction site to another. Furthermore, single beam boom construction makes the mobile crane a more economical option than a gantry system that requires a plurality of beams and support girders. These advantages make the mobile crane a particularly attractive option where crane functions are required for short periods at various construction sites or at different areas within a single large construction site.

Unfortunately, mobile cranes are relatively unsafe. For example, when a mobile crane is loaded and rotated laterally, often the ballast provided by the carriage and machinery deck is insufficient to maintain the crane in a stable position. When unstable, mobile cranes often tip causing damage to both the crane and surrounding structures, and often causing bodily injury to an operator.

Another problem with mobile cranes is that boom movement is not restricted. An unrestricted boom can be pulled back into a vertical position where it collapses over the machinery deck. In addition, as there is no guarantee that the area of boom operation will be free of obstruction, often a mobile crane boom will be mistakenly driven into other construction equipment or environmental structures, causing damage to the boom and other equipment.

While the industry has come up with various solutions to the mobile crane problems identified above, many of the solutions are relatively ineffective in certain industries. In particular, many of the solutions have not been effective in the railroad industry. For example, to stabilize a loaded mobile crane, outriggers or feet (not shown in FIG. 2) are provided which extend laterally from the carriage and contact the surrounding ground. In the railroad industry, while stabilizing outriggers can be used, the degree to which they extend laterally is limited by the construction of a railroad track. As most tracks are positioned on top of a berm, lateral extension is severely limited. Furthermore, as many beams are constructed of coarse rock, often the edge of a berm will be insufficiently stable to support a loaded outrigger. Thus, even when outriggers are used in railroad, because their lateral extension is limited, a mobile railroad crane will often tip when loaded and rotated laterally.

To eliminate the possibility of the boom collapsing over the machinery deck, the industry has come up with boom stops that limit the vertical positioning of the boom. In railroad however, a boom stop can tend to destabilize a crane. The boom stop limits the boom to movement wherein the load is located a substantial distance from the ballasting machinery and deck. Because of the distance, the ballast has less stabilizing effect. This, combined with laterally restricted outriggers, results in a tippable and relatively unstable configuration.

The railroad industry uses cranes for many purposes. In particular, the railroad industry uses cranes to assemble, disassemble, and repair bridges on a regular and scheduled basis. Cranes must be used where building materials, such as prefabricated concrete girders, are extremely heavy. Rapid bridge replacement and maintenance is a high priority for any railroad, as train movement is effectively paralyzed when even a small span of track is inoperable. Thus, despite the mobile crane safety problems identified, railroads usually opt for mobile as opposed to gantry crane systems.

To minimize crane accidents, various procedures are regularly followed. For example, to minimize the lateral angle through which a mobile crane boom must rotate, bridge girders are normally pre-delivered to a construction site and placed at a pickup point adjacent a track in front of a train carriage. Because most berms are steep, the pickup point is usually located a substantial distance from the track on relatively flat and solid footing adjacent the berm. Often, where the footing is not solid, support piles must be driven into the footing to support the girders. To pick up materials, the boom must rotate at least partially laterally into a pickup position where the hook is over the pickup point.

Despite predelivery and efforts to limit lateral rotation, often a boom must be rotated substantially laterally in order to pick up a load. Careless operation under these circumstances has resulted in many tipping accidents.

U.S. Pat. No. 2,562,189 (the "'189 patent") describes a gantry crane system which overcomes many of the problems associated with the swing crane systems and which is transportable. This system was designed specifically for transporting coffins and therefore has a relatively modest length. In addition, because coffins are relatively narrow and must often be transported through spaces not much wider than the coffin itself, the width of this system is particularly narrow. Due to its relatively modest dimensions, this system is light weight facilitating easy movement over the short distances typical in a cemetery.

Unfortunately, while this system is transportable, this system would be impractical for lifting and transporting large items such as bridge girders, prefabricated train tracks, or the like. In particular, if this system where adapted for travel along a railroad track, system width would be limited to the width of a typical track plus a typical lateral overhang on either side thereof. Railroad safety standards limit the maximum width of a railroad car to 9 feet, 2 inches (on an 89 foot car). Therefore, assuming a modest clearance of 1 foot, 3 inches for each girder, this system could not be used to pick up and transport bridge and track sections which have a width greater than 6 feet, 8 inches. Many track and girder sections have widths which exceed 6 feet, 8 inches. In fact, many bridge components have a width as wide as 14 feet. Therefore this system would be virtually useless.

Another shortcoming of the '189 patent system is that the system has a fixed vertical height. The fixed vertical height is disadvantageous as the fixed height fixes the vertical distance between a system deck (e.g. 46 in the '189 patent) and the lifting mechanism (e.g. 27) thereabove. This limitation renders the system unable to lift members which have a vertical dimension which is greater than the fixed vertical distance (i.e. distance between the deck and lifting mechanism above).

The fixed vertical height limitation is not very important in some applications where the '189 system can be designed with a relatively high fixed vertical height. For example, when the '189 system does not have to be transported below overhead fixtures, the fixed vertical height can be extremely high to accommodate large members. Unfortunately, in railroad applications there are various constraints on both the fixed vertical height and the deck height which make the '189 system unworkable. For example, the deck height has to be above the standard height of a railroad coupling. In addition, the fixed vertical height must be lower than the lowest overhead fixture (e.g. bridge) under which the '189 system is to be transported to avoid collision. Thus, the required deck height and limited vertical height place constraints on the types and sizes of members which can be moved via the '189 patent system.

In addition to a crane, the task of disassembling and rebuilding a bridge also often requires many other pieces of construction equipment. For example, often an excavator arm/bucket are required on site to remove debris. In addition, often a pile driver will be required on site for driving footings for bridge pylons into the earth. Other construction equipment is also often required.

While crane stability and use problems have been described above in the context of reconstructing a rail road bridge, similar problems also occur in construction of other types of bridges (e.g. an automobile bridge).

Therefore, it would be advantageous to have a bridge erection system that is mobile yet stable for transporting heavy construction materials to and from, and moving such materials at, construction sites wherein the width of the materials is equal to or slightly less than the maximum allowable safe transport width. In particular, it would be advantageous to have such a system for use in the railroad industry that could eliminate predelivery requirements, is relatively fast, safe, and efficient. Moreover, it would be advantageous to have such a system which can also be used to support various construction tools and which could be transported either by rail or by road.

BRIEF SUMMARY OF THE INVENTION

The present invention includes a crane apparatus comprising a carriage including a deck and at least one truck mechanism connected to an undersurface of the deck, the deck including forward and rearward edges and first and second lateral edges. The invention also includes at least one support member having a distal end, the support member mounted to the deck such that the distal end is laterally extendable from the first edge, first and second glide beams, the first beam coupled to the distal end for movement along a movement axis parallel to a first beam length, the second beam coupled to the deck so as to be essentially parallel and spaced apart from the first beam and for movement essentially parallel to the movement axis, at least one support beam having first and second ends, the first end coupled to the top of the first glide beam and the second end coupled to the top of the second glide beam, the support beam having a variable length component perpendicular to the first glide beam length and at least one lifting mechanism coupled to the support beam, the lifting mechanism including a strand having upper and lower ends and a connector connected to the lower end. With the present invention, the support member is moveable between at least a retracted position and an extended position, when in the retracted position, the distal end adjacent the first lateral edge and when in the extended position, the distal end separated from the first lateral edge, and, wherein, the glide beams are moveable parallel to the movement axis relative to the carriage.

Thus, one object of the invention is to provide a transportable crane system having a width which can be extended laterally so that items which are wider than the crane when the crane is in a transportable retracted configuration can be lifted and moved despite transport configuration limitations. To this end, the support member can be driven laterally to increase the distance between the first and second glide beams thereby increasing the maximum width of an item which can be lifted and transported.

In one embodiment the carriage is a flat bed train car and the truck mechanism consisting of two train trucks.

An object related to the object above is to provide a system of the above kind which is useful in the railroad industry. In the railroad industry, railroad car width is restricted primarily for safety purposes. With the present invention, the width of the crane system can be minimized during crane transport and can then be increased to the expanded width during lifting operations.

One other object is to provide a mobile crane system wherein it is practically impossible for the system to laterally tip. By limiting movement of the glide beam controlled lateral movement and a single longitudinally supported axis, lateral rotation, and thus lateral tipping, is eliminated.

In one aspect the support member is a first support member and the apparatus further includes a second support member having a distal end and mounted to the deck such that the distal end is laterally extendable from the second edge, the second glide beam coupled to the second support member distal end for movement along the movement axis.

One other object of the invention is to provide a relatively wide gantry crane system yet still maintain lateral stability. By providing a system which symmetrically extends laterally on both sides of the carriage, stability is maintained.

In another aspect the first and second support members are a first member pair and the apparatus further includes at least a second support member pair including third and fourth support members having distal ends, the first and second pairs spaced apart along the deck length between the forward and rearward edges, the first glide beam coupled to the first and third support member distal ends and the second glide beam coupled to the second and fourth support member distal ends for movement along the movement axis. Preferably, the apparatus includes more than two support member pairs spaced apart along the deck length.

In yet another aspect, the support beam has a fixed length which forms a variable angle with the first glide beam length and is pivotally coupled at the first and second ends to the tops of the first and second glide beams, the variable angle and support beam length component perpendicular to the first glide beam changeable as the support member is moved between the retracted and extended positions.

One other object is to provide a variable width gantry crane wherein support beams for hoist assemblies are formed of single integral beam members despite the requirement that they change length in the direction perpendicular to the glide beams. To this end, the support beams form an angle with the glide beams and the angle changes during extension or retraction to provide additional strength to the system.

Preferably the support beam is a first support beam and the apparatus further includes a second support beam spaced apart from the first support beam, the second support beam having first and second ends which are coupled for pivotal movement to the tops of the first and second glide beams, respectively, the first and second support beams arranged such that they are essentially parallel, the lifting mechanism coupled to and supported by both the first and second support beams. This configuration adds additional strength to support the hoist assembly.

In another aspect upper edges of the first and second glide beams form channels which extend along at least a portion of respective glide beams, the support beam coupled to first and second roller assemblies at first and second ends, respectively, the roller assemblies receivable within the channels and moveable therealong so as to change the position of the support beam relative to the glide beams. In addition, an upper edge of the support beam upper forms a channel and the lifting mechanism includes a roller assembly receivable within the channel and moveable therealong so as to change the position of the lifting mechanism along the length of the support beam.

Yet another object is to provide gantry support for a hoist assembly within the area defined by two glide beams. When the beams are above the carriage, the hoist assembly can be located at various points above the deck. When the beams are extended and adjacent either a forward or rearward edge of the carriage, the hoist assembly can be located above an area adjacent the deck between extended portions of the glide beams.

Also, preferably, two support beams, each fitted with a separate hoist assembly, are connected for movement along the length of, and between, the glide beams.

Another object is to provide means for safely lifting a long item, and specifically for lifting a bridge girder for movement. By positioning the two hoist assemblies above different ends of a girder, the hoist assemblies operate together to lift and move a girder laterally between the beams.

By lifting construction items over the deck, as opposed to rotating the items laterally relative to the deck, lateral tipping is eliminated. In addition, as the present invention can safely pick up even heavy materials from an area behind the deck, it is not necessary to pre-deliver materials to a construction site or to use pile supports. Materials can be supplied on a separate supply car connected behind the deck.

Importantly, the deck may form a carrying surface. Thus, another object is to provide a crane system where the system can also carry girders or other construction materials to a construction site. Preferably, a motorized motivation means is included for moving the glide beams relative to the deck.

In other aspects, the invention also includes a method of using the aforementioned system and also a system including any of a plurality of different tools (e.g. crane tool, pile driver, excavation arm, etc.) secured to one or more support beams. According to another aspect of the invention, a second track mechanism having a second support member is used to pull the glide beams parallel to the movement axis.

In another aspect, the invention includes truck mechanisms which include both a tire truck and train truck and a jacking mechanism linked to a first of the tire or train trucks, when the jacking mechanism is in a retracted position, the second of the trucks supporting the apparatus and, when extended, the first of the trucks supporting the apparatus. This feature enables transport of the inventive apparatus by either rail or more conventional roadways for use in other than rail applications.

The invention also includes an automatic control system which synchronizes lateral expansion and contraction of the glide beams during opening and closing procedures, respectively.

Moreover, preferably, the bottom ends of the glide beams curve up and inwardly to facilitate insertion and reception of the glide beams during axial movement.

Furthermore, preferably, a guide beam is linked to the distal ends of the support members which are on the same side of the of the apparatus and the glide beams are each supported and guided by the guide beams. The guide beams add further support to the glide beams and maintain the distal ends of the support members in essentially a single supporting plane.

In yet another aspect the invention includes first and second crane apparatus of the above kind wherein adjacent glide beam ends can be linked/secured together so that the glide beam expanse can be doubled. It is also contemplated that more than two crane glide beam systems could be secured together to further increase the maximum expanse.

According to yet another aspect of the invention lifting mechanisms or vertical lifters are provided between each support member distal end and a linked glide beam so that the glide beams can be vertically raised thereby increasing the vertical distance between the top of a system deck and a lifting mechanism thereabove. This feature enables a relatively low system profile for transport and a higher lifting profile for lifting operations thereby accommodating movement of large depth members.

The foregoing and other objects, aspects and advantages of the invention will appear from the following description. In the description, reference is made to the accompanying drawings which form a part hereof, and in which there is shown by way of illustration preferred embodiments of the invention. Such embodiments do not represent the full scope of the invention. Reference is made therefore to the claims herein for interpreting the full scope of the invention.

BRIEF DESCRIPTION OF THE SEVERAL VIEWS OF THE DRAWINGS

FIG. 27 is an end view of one embodiment of the inventive truss assembly;

FIG. 28 is a perspective view of an exemplary remote control device;

FIG. 29 is a block diagram of the processor/controller of FIG. 27;

DETAILED DESCRIPTION OF THE INVENTION

Figure 5:
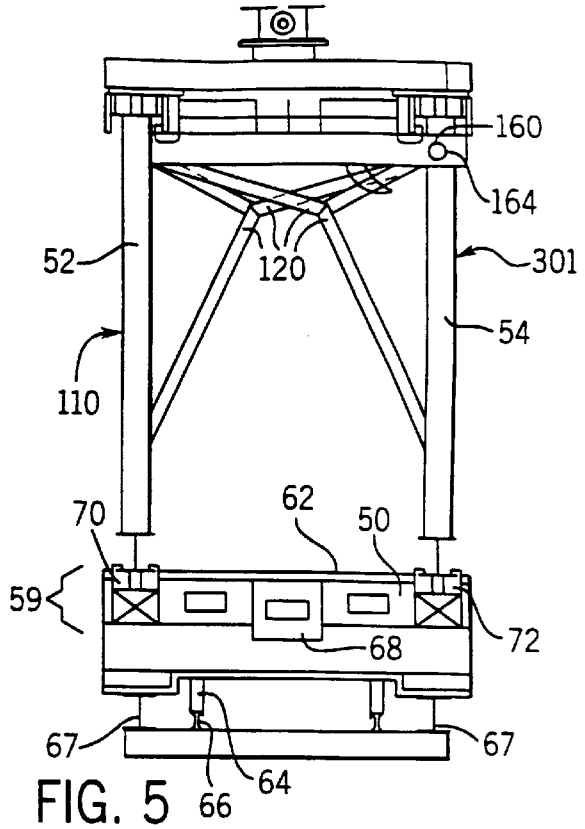
FIG. 5 is an end view of the system shown in FIG. 3 with the system in a retracted position.
Figure 6:
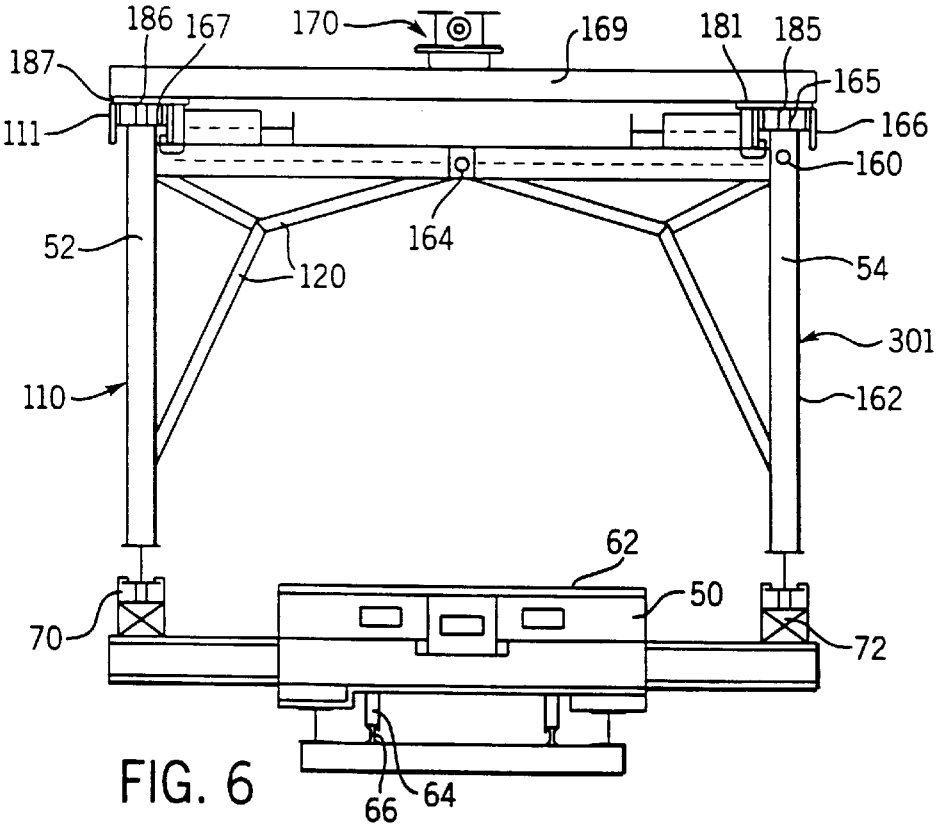
FIG. 6 is similar to FIG. 5, albeit with the system in an expanded position.

Generally speaking, referring to FIGS. 5 and 6, the present invention allows a crane assembly which has a maximum allowable width during transport to easily be widened at a construction cite for lifting and moving construction items that would be to wide for movement with the crane in the transport configuration. FIG. 5 shows the inventive assembly in a transport configuration while FIG. 6 shows the assembly in a wide lifting configuration.

A. System Hardware

Figure 1:
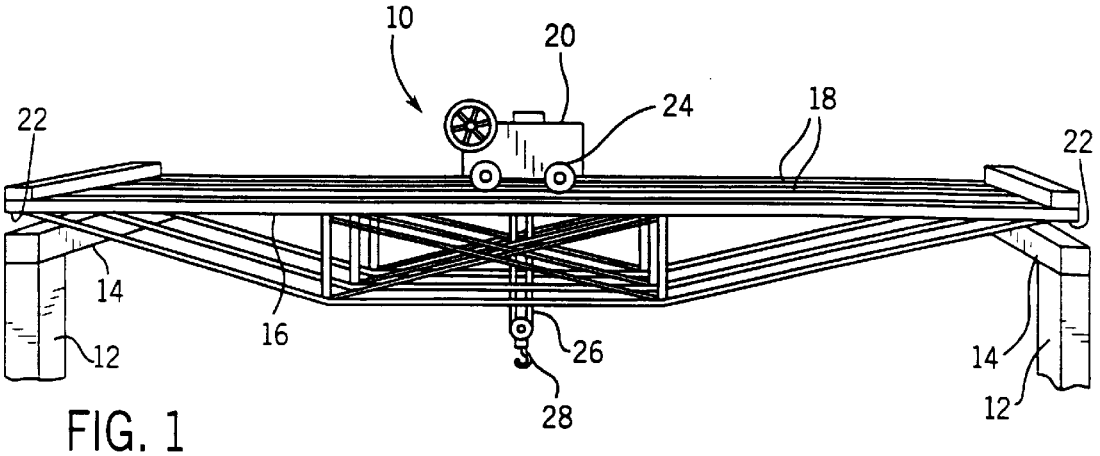
FIG. 1 PRIOR ART
FIG. 1 is a prior art gantry crane system.
Figure 2:
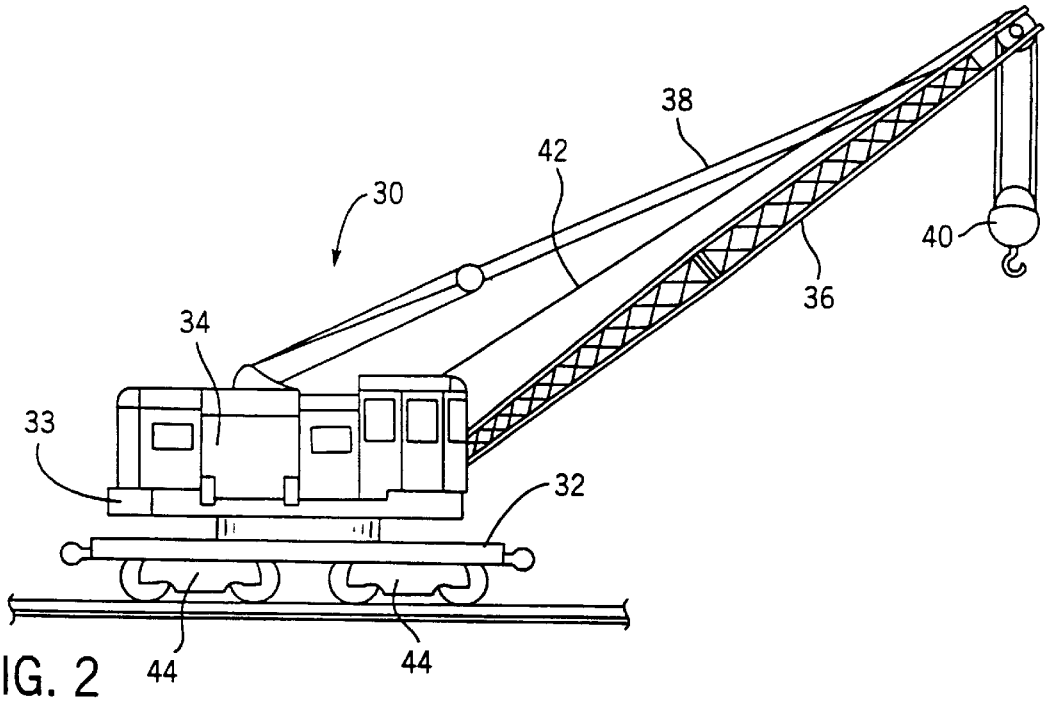
FIG. 2 PRIOR ART
FIG. 2 is a prior art mobile locomotive crane system.
Figure 3:
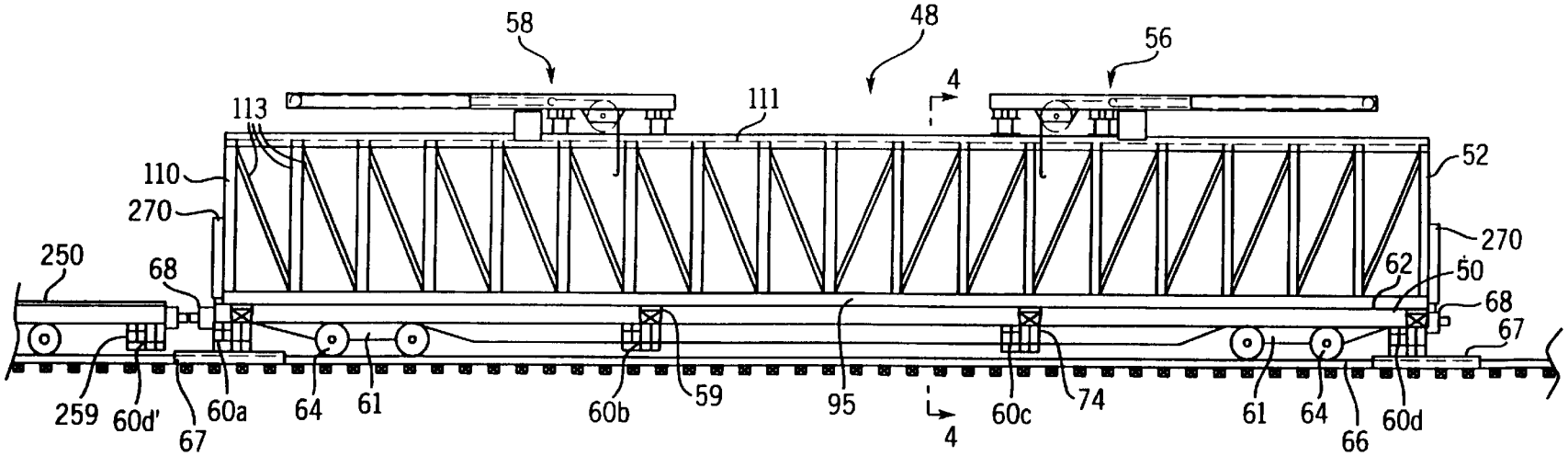
FIG. 3 is a side elevational view of a crane system according to the present invention.

Referring now to FIGS. 3 and 5, an inventive crane system 48 includes a carriage 50, first and second glide truss assemblies 52, 54 (see FIG. 12), first and second crane assemblies 56, 58 (see FIG. 11), a lateral extension assembly 59 (see FIG. 7), and various other components described in more detail below. Carriage 50 is preferably a flat elongated rectangular member similar to the flat bed of a truck or the flat bed of a railroad car. The carriage 50 provides a flat, substantially horizontal deck 62.

Figure 4:
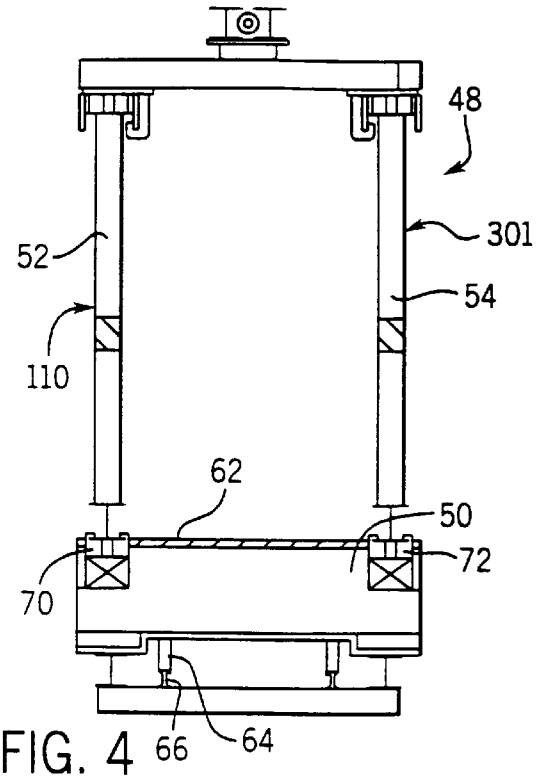
FIG. 4 is a cross-sectional view of the system shown in FIG. 3 taken along the line 4—4.

In the preferred embodiment shown in FIGS. 3 and 4, the invention is configured for use in conjunction with a railroad. To this end, the carriage 50 is supported by two railroad trucks collectively referred to by the numeral 61 which are positioned beneath the carriage 50, one truck 61 on either end. Each truck 61 includes a plurality of wheels 64 spaced apart in accordance with the specifications of a railroad track 66 therebelow. Each truck 61 also includes an automatic coupler 68 extending longitudinally further than carriage 50. Couplers 68 cooperate with couplers on other railroad cars for attachment thereto.

Figure 7:
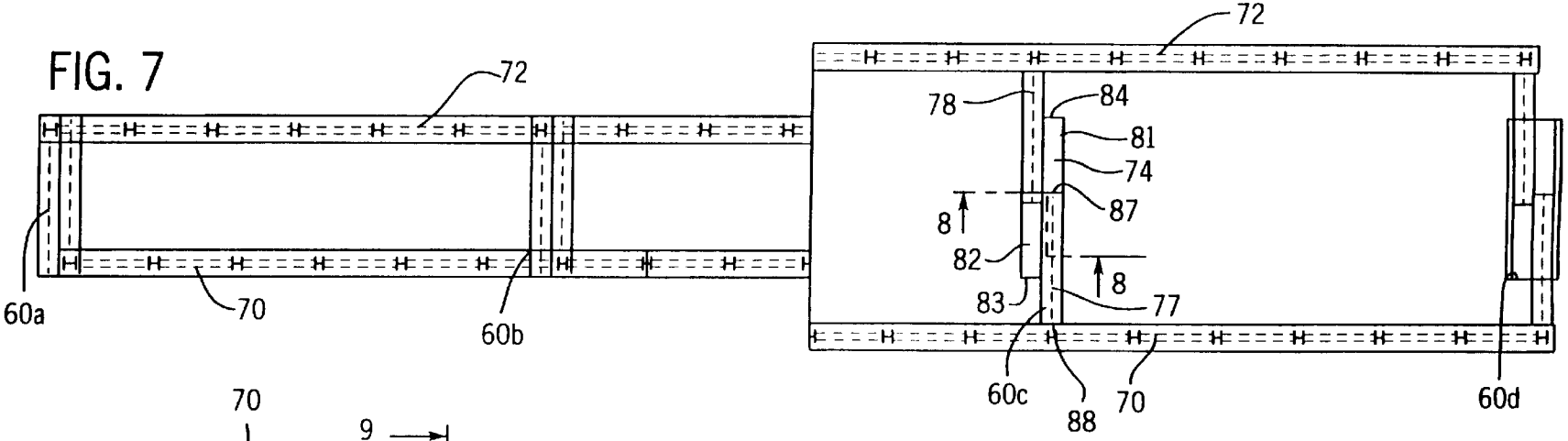
FIG. 7 is a top plan view of a lateral extension assembly according to the invention.

Lateral extension assembly 59 is used to increase the distance between trusses 52 and 54 to accommodate relatively wide construction items. Referring to FIG. 7, the left half of that figure illustrates assembly 59 in a retracted transport configuration while the right half illustrates assembly 59 in an expanded configuration. Assembly 59 includes a plurality of support assemblies 60*a,* 60*b,* 60*c* and 60*d* and first and second lateral beams 70 and 72. Assemblies 60*a* through 60*d* are identical and therefore only assembly 60*c* will be explained here in detail.

Figure 8:
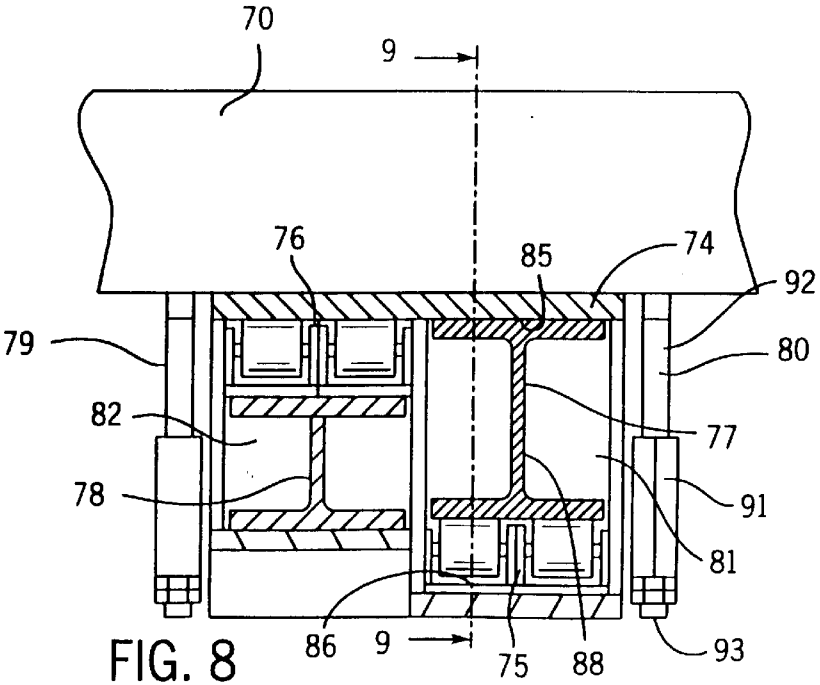
FIG. 8 is a cross-sectional view taken along the line 8—8 of FIG. 7.
Figure 9:
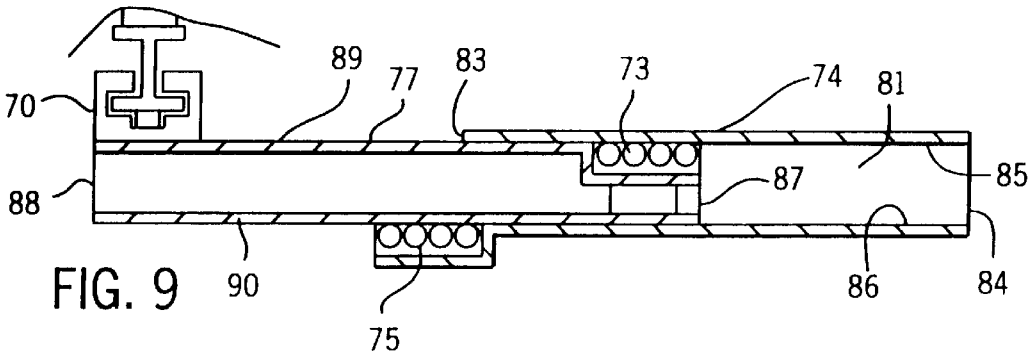
FIG. 9 is a cross-sectional view taken along the line 9—9 of FIG. 8.

Referring also to FIGS. 8 and 9, assembly 60*c* includes a sleeve member 74, first 73, second 75, third (not illustrated) and fourth 76 roller assemblies, a support member pair including first and second support members 77, 78 and first and second stabilizer assemblies 79, 80. Sleeve 74 forms first and second parallel channels 81, 82, each channel 81, 82 is open at first and second opposite ends 83, 84 and each channel having an upper inner surface and a lower inner surface 85, 86, respectively.

Assemblies 73, 75 and 76 are typical roller assemblies including a plurality of wheels mounted on parallel axis to facilitate roller action perpendicular to the axis. Second assembly 75 is secured to lower surface 86 adjacent first end 83 to facilitate movement therealong. Similarly, although not illustrated, the fourth roller assembly is secured to a lower surface of channel 82 adjacent second end 84.

Support members 77 and 78 are essentially identical and therefore only first member 77 will be explained here in detail. Referring to FIGS. 7 through 9, member 77 is a beam having proximate and distal ends 87, 88 and upper and lower surfaces 89, 90. First roller assembly 73 is secured on the upper surface at proximate end 87 and lateral beam 70 is secured to the upper surface 89 at the distal end 88. Preferably, two strengthening members 91 are welded into proximate end 87 for support.

When assembled, proximate end 87 is received inside channel 81 with assembly 73 bearing on upper surface 85 and assembly 75 bearing on surface 90 such that assemblies 73 and 75 cooperate to allow easy movement of support member 77 between the retracted (see FIG. 5) and expanded (see FIG. 6) positions. Similarly, member 78 is received inside channel 82 for movement in the opposite direction.

Figure 9A:
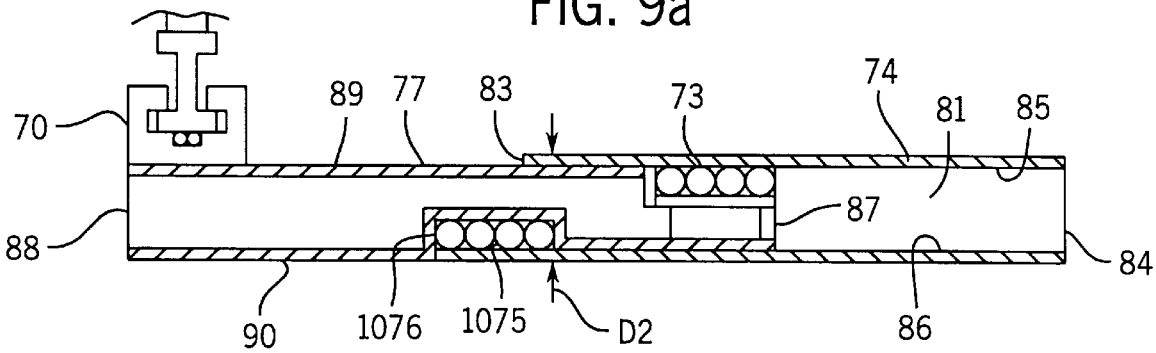
FIG. 9*a* is similar to FIG. 9, albeit having a reduced depth design.

Referring to FIG. 9*a,* a second and preferred embodiment of the extension assembly of FIG. 9 is illustrated. In FIG. 9*a,* most of the components are essentially identical to the components of FIG. 9 and similar components are identified by identical numbers. Because operation of the similar components is described above, those components are not described here in detail. The unique feature of the FIG. 9*a* assembly is that, instead of providing roller assembly 75 (see FIG. 9) in the surface of channel 81, a roller assembly 1075 is mounted within a recess 1076 in the undersurface of support member 77. This feature is important as it reduces the depth of the extension assembly essentially by the dimension of assembly 1075. To this end, compare dimension D1 in FIG. 9 to dimension D2 in FIG. 9*a*. Dimension D2 is less than dimension D1. By reducing the depth of the extension assembly the deck height (see 62 in FIG. 6) can be dropped an equal amount thereby increasing the vertical distance between the deck 62 and the lifting mechanism 170 thereabove. While this minimal distance increase may seem minimal, in reality it can increase the vertical distance by as much as several inches thereby rendering the system useable for more applications.

Referring again to FIGS. 3 and 4, sleeve 74 is secured to the under surface of carriage 50 such that distal ends 88 are laterally displaced on opposite sides of deck 62.

Referring again the FIG. 8, stabilizer assemblies 79, 80 are provided on opposite sides of sleeve 74. Assemblies 79, 80 can be connected to sleeve 74 in any known manner, but should be connected so that, when extended, they clear the other system components therebelow. Each assembly 79, 80 includes a hydraulic tube 91, a telescoping extension member 92 which is stored in tube 91, and a foot member 93 connected to the distal end of member 92.

Members 92 can be placed in a stored position (see FIG. 8) wherein the member 92 is fully retracted. Members 92 can also assume operating positions wherein they are fully extended so that foot 93 contacts a secure surface therebelow. When truss assemblies 52 and 54 or support members 60*a* through 60*d* are being moved, members 92 are in the retracted position. When assemblies 52, 54 and/or members 60*a* through 60*d* are stationary, preferably, although not necessarily, members 92 should be extended.

Referring also to FIG. 3, spreader beams collectively referred to by the numeral 67 are provided at and connect the distal ends of adjacent members 92. When members 92 are expanded, beams 67 contact rail road ties or the like thereunder and provide stability to carriage 50 thereabove.

To move assembly 72 from the retracted to the extended positions and vice versa, any manner known in the art can be used including hydraulics, cables and winches or separate servo motors. Although not illustrated, preferably a hydraulic motor system is provided to facilitate desired movement under remote operator control.

Figure 10:
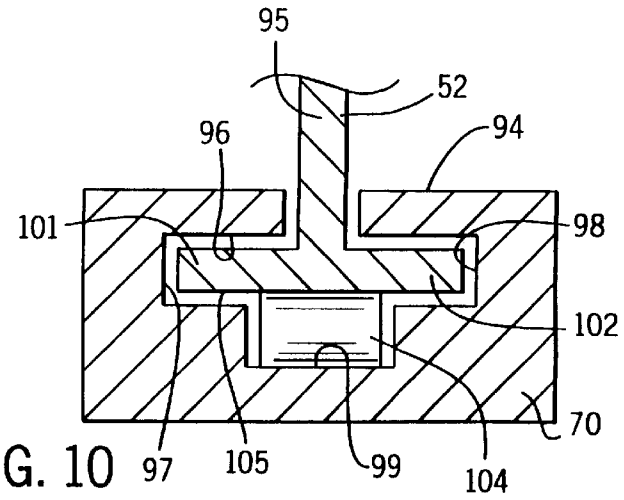
FIG. 10 is a cross-sectional view of a lateral beam of FIG. 4.

Lateral beams 70 and 71 are essentially identical and therefore only beam 70 will be described here. Referring to FIG. 10, an upper edge 94 of beam 70 forms a channel 96 for receiving and supporting the bottom I-beam 95 of truss assembly 52 for movement therealong. To this end, channel 96 includes oppositely facing lateral passages 97 and 98 and a roller recess 99. A plurality (one illustrated) of roller assemblies 104 are provided along the length of recess 99. Lateral extensions 102 and 103 at the bottom of beam 95 are received within passages 97 and 98 and a lower surface 105 of beam 95 rests on roller assembly 104 which facilitates I-beam movement. Thus, with I-beams 95 supported for movement within and along channel 96, trusses 52 and 54 can move along beams 70 and 71 and thereby along the length of carriage 50.

Figure 12:
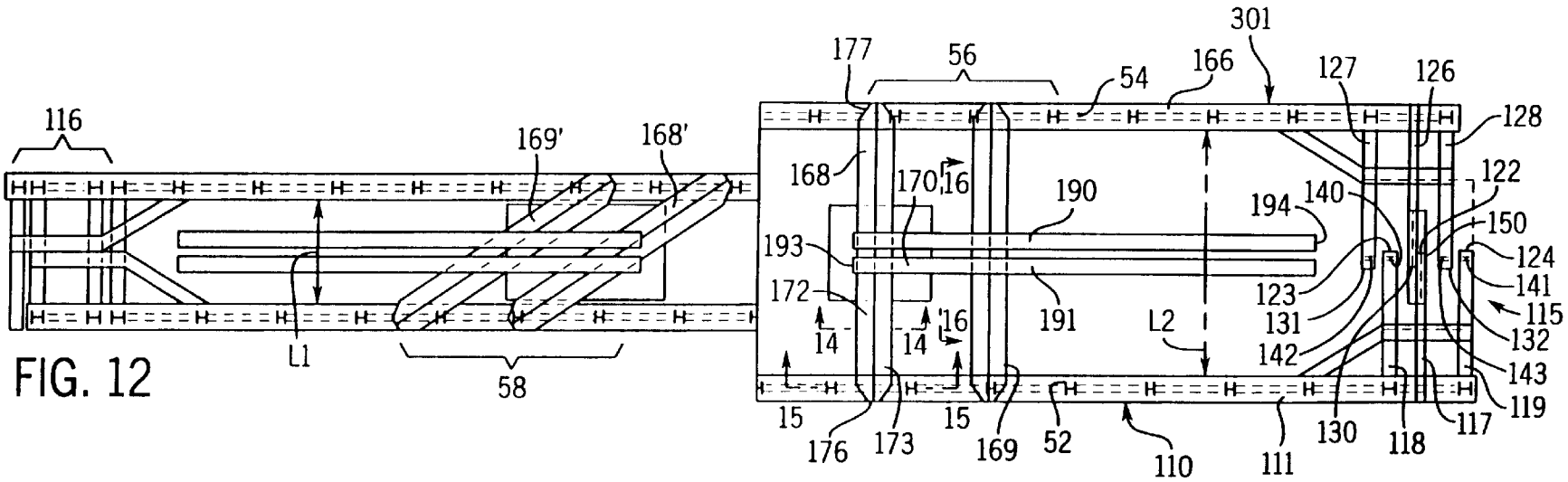
FIG. 12 is a top plan view of a truss assembly according to the present invention.
Figure 13:
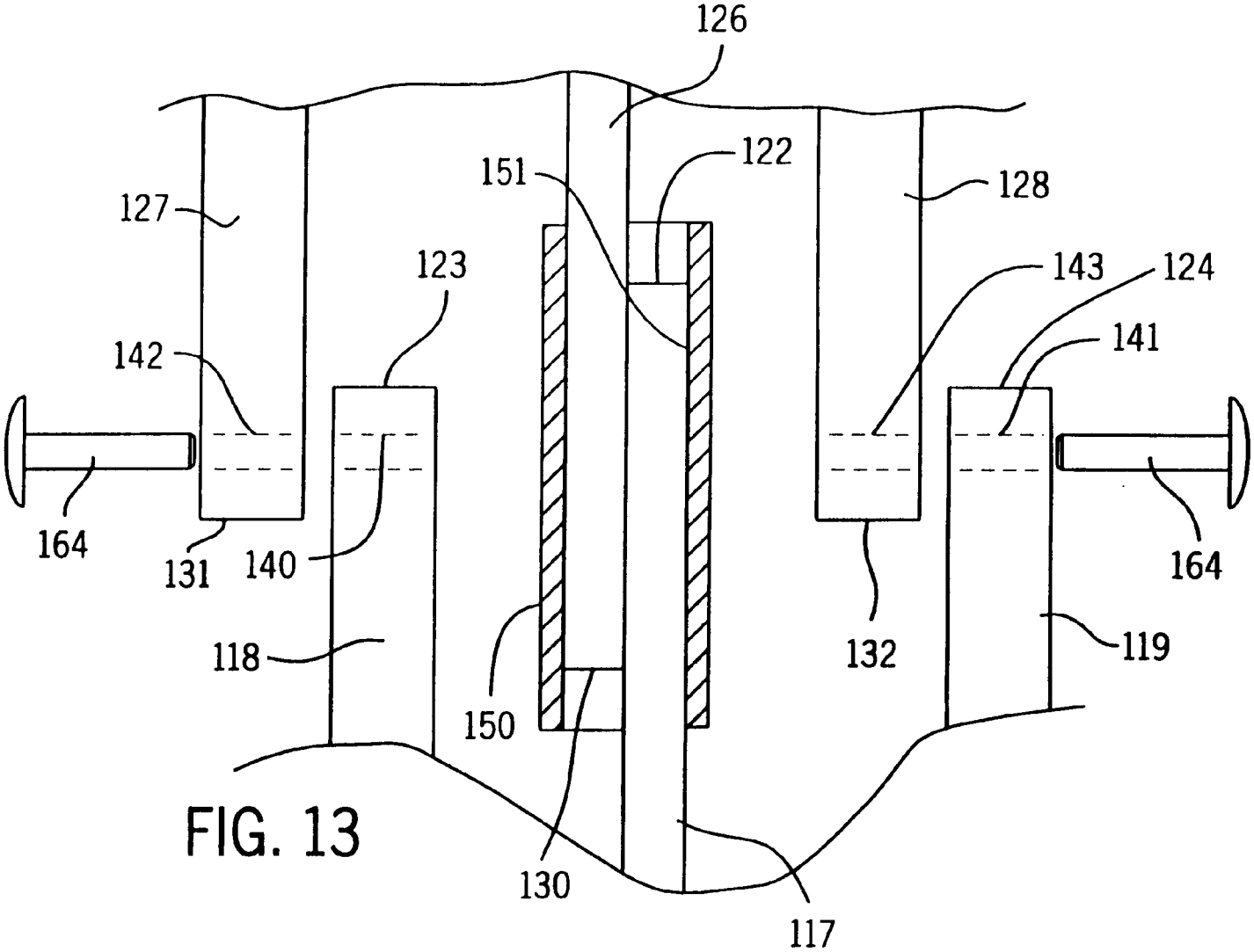
FIG. 13 is a partial enlarged view of the brace members of FIG. 12.

Referring to FIGS. 3 through 6 and 12, truss assemblies 52 and 54 are essentially identical and therefore, unless necessary to describe how the two assemblies 52 and 54 cooperate, only assembly 52 will be explained in detail here. In FIG. 12 assemblies 52 and 54 are illustrated in the retracted and expanded configurations on the left and right hand sides, respectively. Truss assembly 52 includes a glide beam 110 and a plurality of brace beams 117, 118 and 119 (see FIGS. 12 and 13). Beam 110 includes parallel upper and lower beams 111 and 95, respectively, and a plurality of latticed supporting beams collectively referred to by the numeral 113 which traverse the distance between beams 95 and 111. The distance between beams 95 and 111 will typically be on the order of ten to sixteen feet.

Referring specifically to FIGS. 5, 6, 12 and 13, the brace beams include first and second sets of beams 115, 116, one set at either end of beam 110. Sets 115 and 116 are essentially identical and therefore only set 115 will be explained here. Set 115 includes a stabilizer beam 117 and two locking beams 118, 119, one on either side of beam 117. All beams 117, 118 and 119 are secured at proximal ends below upper beam 111 and extend perpendicular thereto toward truss assembly 54 terminating at distal ends 122, 123 and 124, respectively. As seen in FIGS. 5 and 6, a lattice of support beams collectively referred to by the numeral 120 are provided to support beams 117, 118 and 119 in their perpendicular positions. Distal ends 123 and 124 form locking apertures 140 and 141 therethrough.

Three similar beams, including a stabilizer beam 126 and two locking beams 127, 128, one on either side of beam 126, extend from just below the upper beam of assembly 54 toward assembly 52 (see FIG. 12). Each of beams 126, 127 and 128 terminate at distal ends 130, 131 and 132, respectively, and distal ends 131 and 132 form locking apertures 142 and 143 similar to apertures 140 and 141.

An elongated sleeve 150 forms a single channel 151 which is open at both ends and is formed to slidably receive distal ends 122 and 130, thereby maintaining ends 122 and 130 parallel. When truss assemblies 52 and 54 are mounted on carriage 50, beams 117 and 126 are adjacent and received in channel 151. In addition, beams 118 and 127 are adjacent and beams 119 and 128 are adjacent (see FIG. 13). A locking aperture 160 is also provided in the upper end of an end support beam 162 (see FIG. 6).

Beams 117 and 126 and sleeve 150 cooperate to provide sufficient support to assemblies 52 and 54 during movement between the expanded and retracted positions and vice versa. While they do provide some support for assemblies 52 and 54 during lifting or transport operations, beams 117 and 126 are not provided for this purpose.

When assemblies 52 and 54 are in the expanded configuration (see right-hand side FIG. 12), apertures 140 and 142 align and apertures 141 and 143 also align. When expanded with apertures 140, 142 and 141, 143 aligned, one or more locking members collectively referred to by numeral 164 can be forced through adjacent apertures to lock adjacent beams together and provide end support to truss assemblies 52 and 54. To secure assemblies 52 and 54 in the retracted position for transport or for lifting narrow items, once the retracted position is attained, members 164 can again be used to lock assemblies 52 and 54 relative to each other via apertures 141 and 160 (see FIG. 5).

Referring to FIG. 6, I-beams 111 and 166 at the top of truss assemblies 52 and 54 are configured so that each forms an upwardly opening channel 167, 165, respectively, for receiving roller assemblies therein.

Figure 11:
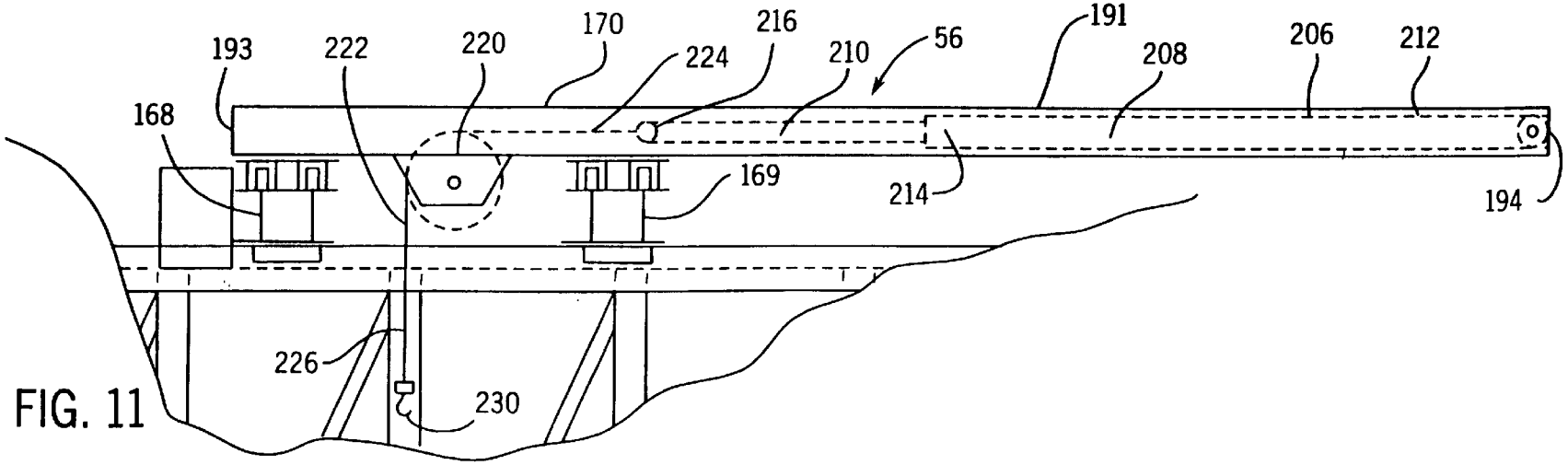
FIG. 11 is a partial enlarged view of the hoist assembly of FIG. 3.

Referring again to FIG. 3, each of the first and second crane assemblies 56, 58 is essentially identical except that they are positioned in different locations. Therefore, only assembly 56 will be explained here. Referring also to FIGS. 6, 11 and 12, assembly 56 includes first and second support assemblies 168, 169 and a hoist assembly 170. Each of assemblies 168 and 169 are essentially identical and therefore only assembly 168 will be explained here.

Figure 14:
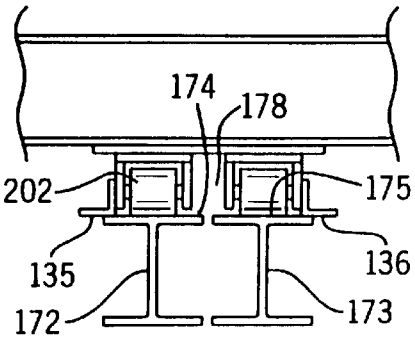
FIG. 14 is a cross sectional view taken along the line 14—14 of FIG. 12.

Referring specifically to FIGS. 12 and 14, assembly 168 includes two parallel I-beams 172, 173 which traverse the distance between upper beams 111 and 166. Each beam 172 and 173 has an upper surface 174, 175, respectively, and first and second ends 176, 177, respectively. Along opposite and spaced apart edges of upper surfaces 174 and 175 first and second "L" shaped track members 135, 136 are welded so as to form a roller assembly receiving channel 178 therebetween.

Figure 15:
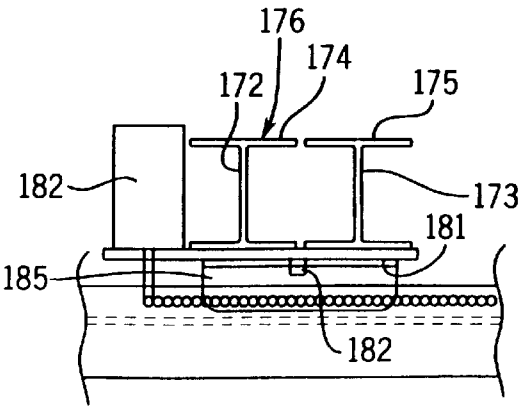
FIG. 15 is a cross sectional view taken along the line 15—15 of FIG. 12.

Referring also to FIG. 15, end 176 is integrally attached to a pivot plate 181 which includes a centrally located and downwardly extending pivot post 182. A hydraulic motor 183 is also provided on plate 181. Similarly, end 177 is attached to a pivot plate 187 (see FIG. 3) having a downwardly extending post (not illustrated).

Referring to FIGS. 3, 6 and 15, a roller assembly 185 is pivotally secured beneath plate 181 (i.e. post 182 is received for rotation within a suitably sized aperture). Similarly a roller assembly 186 is secured beneath plate 187 at the other end of beams 172, 173. Assemblies 185 and 186 are received in channels 165 and 167 along beams 111 and 166 (see FIGS. 6 and 12). Thus, beams 172 and 173 are moveable along channels 165 and 167. Motor 183 facilitates movement along channels 165 and 167 via hydraulic lines (not shown) connected and supplied by motor 182 in any manner known in the art.

Referring to FIGS. 6, 11, 12 and 16, hoist assembly 170 can be any type of hoist assembly known in the art which can raise and lower a cable below assemblies 168 and 169. Preferably, assembly 170 includes first and second I-beams 190, 191 which are adjacent and parallel, have proximal and distal ends 193, 194, respectively, and form a channel 195 therebetween. Ends 193 are coupled to assembly 168, beams 190 and 191 extending therefrom over and past assembly 169. Beams 190 and 191 are also coupled to assembly 169 at the point where they cross there-over.

Figure 16:
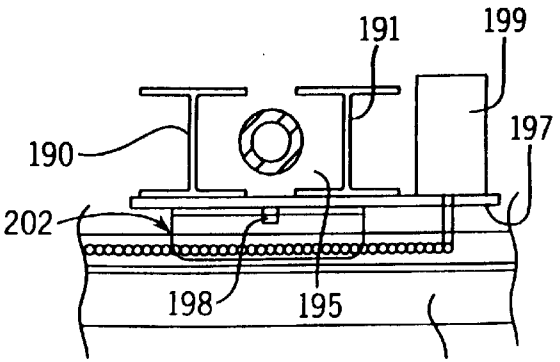
FIG. 16 is a cross sectional view taken along the line 16—16 of FIG. 12.

Coupling of beams 190 and 191 is similar to the couplings of ends 176 and 177 to beams 111 and 166. Thus, distal ends 193 are secured to a pivot plate 197 having a pivot post 198 extending centrally and downwardly therefrom. Another hydraulic motor 199 is provided on plate 197. Referring to FIGS. 14 and 16, post 198 is received in a suitably sized aperture in the top of a roller assembly 202 which is in turn received in channel 178 for movement therealong. Although not illustrated, beams 190 and 191 are similarly coupled to assembly 169 via a pivot plate and a roller assembly such that beams 190 and 191 can move along assembly 169 between truss assemblies 52 and 54.

Referring to FIGS. 11 and 16, a telescopic hydraulic ram assembly 206 is secured between beams 190 and 191. Ram 206 includes a sleeve 208 and an extension member 210. Sleeve 108 has proximal and distal ends 212, 214 and is secured at proximal end 212 to the distal ends 194 of beams 190 and 191. Member 210 is received within sleeve 208 and has a distal end 216 which extends from distal end 214. A pulley 220 is mounted for rotation between beams 190 and 191 and between assemblies 168 and 169. A cable or lifting strand 222 has proximal and distal ends 224, 226, respectively. End 224 is secured to end 216 of member 208. Cable 22 passes between beams 190 and 191, over pulley 220 and extends downwardly to end 226. A hook, electromagnet or some other securing device 230 is secured to end 226.

In operation, a hydraulic pump provides hydraulic fluid to ram 206 to move distal end 216 relative to pulley 220. As end 216 moves, hook 230 is raised and lowered below pulley 230.

Referring once again to FIG. 3, a second flat bed train car 250 is illustrated. Car 250 is fitted with a lateral extension assembly 259 identical to assembly 59 described above. Therefore, car 250 can support truss assemblies 52 and 54 in the same manner as assembly 59. Having two or more train cars fitted with lateral extension assemblies is particularly useful as will become apparent below.

Referring to FIG. 3, telescopic supports collectively referred to by numeral 270 are provided at the ends of assemblies 52 and 54. Supports 270 are essentially the same as assemblies 79 and 80 and therefore are not described here in detail. Suffice it to say that supports 270 can extend downwardly to a surface therebelow to provide additional support to assemblies 52 and 54, especially when assemblies 52 and 54 are in extended positions.

B. Operation

In operation, referring to FIGS. 3, 4 and 5, with assemblies 59, 52 and 54 in the retracted configuration, locking members 164 (see FIG. 13) can be used to secure beams 118 and 127 and beams 119 and 128 to provide end support to assemblies 52 and 54 for transport. In this configuration the width of system 48 should meet conventional safety standards for railroad travel. Also, in this configuration, assemblies 168 and 169 will form acute angles with beams 111 and 166 and will have a beam length component L1 which is perpendicular to glide beam 110 and beam 111 (see FIG. 12). In other words, assemblies 168 and 169 will be arranged like assemblies 168' and 169' on the left-hand side of FIG. 12. Moreover, beams 190 and 191 will be arranged so as to be parallel to beams 111 and 166 (see 190' and 191' on left-hand side FIG. 12).

System 48 can be transported to a construction cite (e.g. a bridge to be disassembled and replaced) either by a motor integrally provided with system 48 or under tow. Once at a construction cite, assuming a construction item which is wider than the distance between assemblies 52 and 54 needs to be picked up and moved, locking members 164 are removed so that assemblies 60*a* through 60*d* can be driven from the retracted into the extended configurations. With members 164 removed, members 77 and 78 associated with each assembly 60*a* through 60*d* are driven laterally outwardly forcing lateral beams 70 and 72 and assemblies 52 and 54 away from carriage 50 in opposite directions. As assemblies 52 and 54 are driven outwardly, assemblies 168 and 169 (and assemblies 168' and 169') pivot at both ends 176 and 177 from the positions illustrated on the left-hand side of FIG. 12 to the positions illustrated on the righthand side of FIG. 12. After extension, the beam length component perpendicular to glide beam 110 (i.e. beam 111) will be L2. Preferably, once the extended configuration is attained, assemblies 168 and 169 are not precisely perpendicular to beams 111 and 166, but instead are slightly skewed (e.g. 3 to 5 degrees) toward their retracted positions. Upon retracting members 77 and 78, this skewing causes assemblies to "fold" back into their original retracted positions instead of attempting to fold in the opposite direction.

With assemblies 52 and 54 in the extended configuration and apertures 140 and 142 aligned and apertures 141 and 143 aligned, members are inserted therethrough (see FIG. 13) to lock brace beams 118, 127 and 119, 128 together. A similar locking procedure is performed at both ends of assemblies 52 and 54. Prior to moving assemblies 52 and 54 along beams 70 and 72, stabilizer assemblies 79, 80 should be extended to provide added support to carriage 50.

Figure 17:
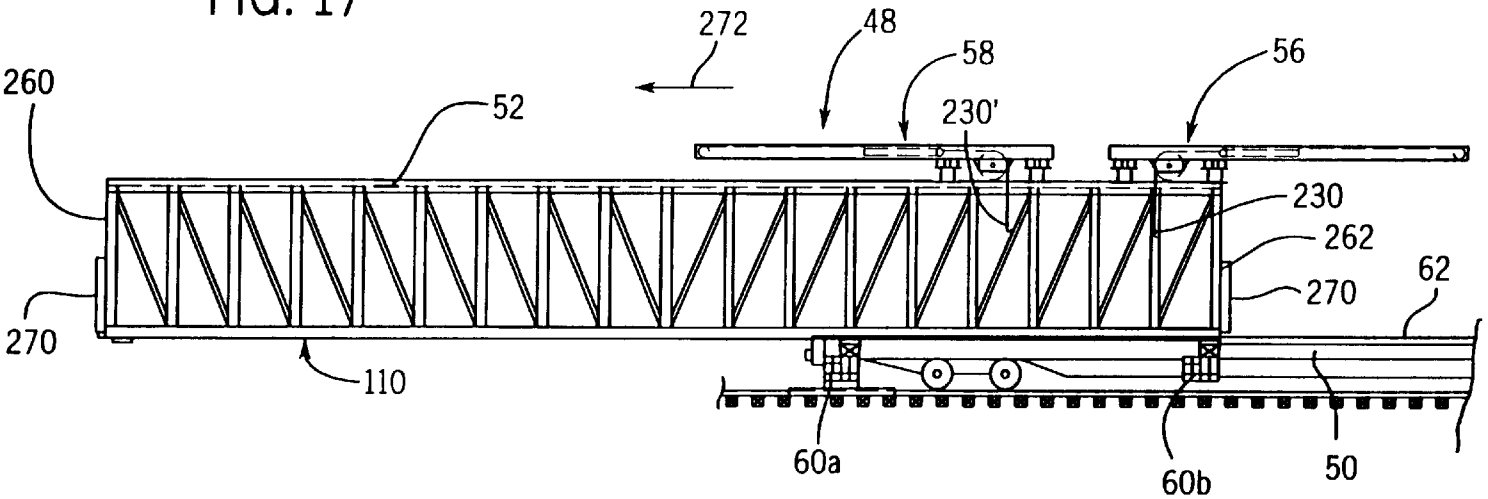
FIG. 17 is a side elevational view of the assembly of FIG. 1 with the truss assembly extended from a rail car.

Next, one of two different general types of operations can be performed. First, referring to FIG. 17, where only one train car is used to lift an item, truss assemblies 52 and 54 can be driven along beams 70 and 72 in a direction so as to place a first end 260 of assemblies 52 and 54 above an item to be moved. For the purposes of this explanation, although assemblies 52 and 54 could be moved in either direction along the lengths of beams 70 and 72, it will be assumed assemblies 52 and 54 are moved in such that sections of assemblies 52 and 54 remain above assembly 60*a*.

Assemblies 52 and 54 can be driven to the point where a second end 262 opposite end 260 is just above assembly 60*b*. In this case, assemblies 52 and 54 are supported by assemblies 60*a* and 60*b*. When assemblies 52 and 54 are in a position over an item to be moved, supports 270 can be extended downwardly. This is especially true at end 260 to provide support thereat. Next, assemblies 58 and 56 are moved in the direction indicated by arrow 272 until hooks 230 and 230' are above the item to be lifted. Assemblies 58, 56 are driven to lower hooks 230 and 230', hooks 230, 230' are secured to the item to be lifted, and assemblies 58 and 56 are driven to lift the item below assemblies 168 and 169. With the item lifted, assemblies 58 and 56 are moved in a direction opposite arrow 272 to move the item into an area over deck 62.

The lifted item can be placed on deck 62 for transport or, in the alternative, can be placed on a different car for removal. If desired, a plurality of rollers (not illustrated) can be provided on the surface of deck 62 to facilitate item movement therealong. For example, once one end of an item is placed on deck 62, hook 230 can be removed from the item and assembly 58 along could be used to move the item along deck 62.

After supports 270 are retracted, assemblies 52 and 54 can be moved back over carriage 50 or can be driven off the opposite side of carriage 50 to further move an item to a different car for further transport.

Figure 18:
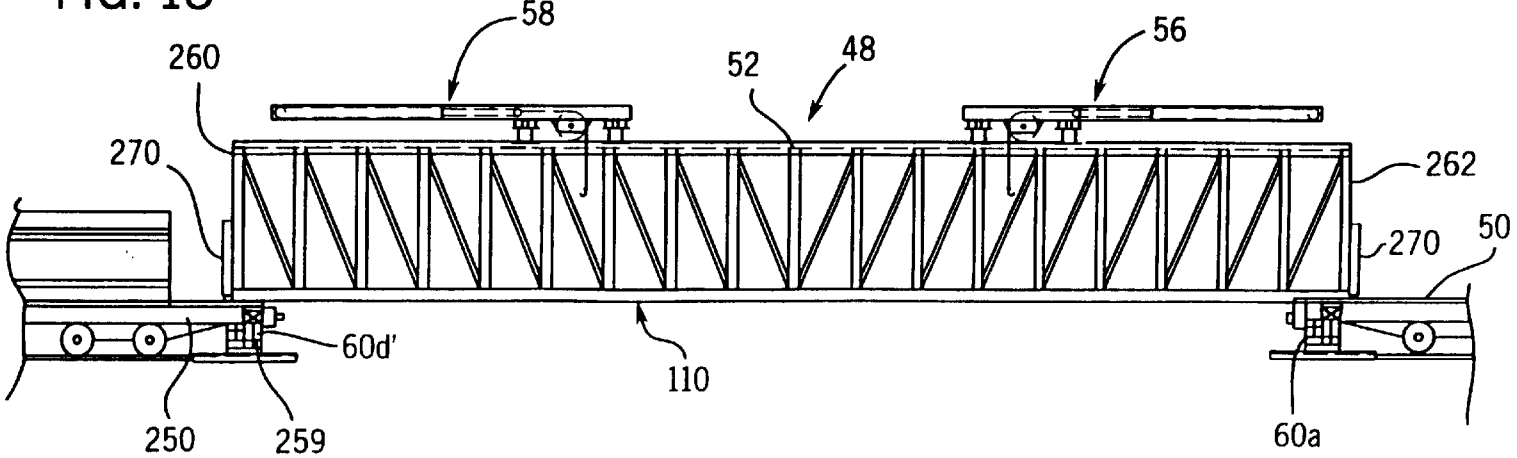
FIG. 18 is similar to FIG. 17, albeit with the truss assembly supported by two rail cars.

Second, referring to FIG. 18, system 48 can be used with a second car 250 fitted with a lateral extension assembly 259 to provide enhanced lifting operations. In this case, with assemblies 52 and 54 in the extended configuration (see FIG. 6) and associated assembly 259 in an identical extended configuration, assemblies 52 and 54 are driven out past assembly 60*a* and over an adjacent car 250 and associated assembly 60*d'* (see FIG. 3). End 260 of assemblies 52 and 54 is secured to assembly 60*d'*. Car 250 is driven away from assembly 60*a* pulling assemblies 52 and 54 therewith until end 262 is directly above assembly 60*a*. In this case, assemblies 52 and 54 form a bridge from assembly 60*a* to 60*b* and hoist assemblies 58 and 56 can be used to raise and lower items therebetween. Here, assemblies 58 and 56 can only be used between assemblies 52 and 54, it is particularly advantageous to provide roller assemblies on surfaces 62.

FIG. 18 illustrates assembly 48 configured after a bridge section has been removed. After a bridge has been replaced under assemblies 52 and 54, car 250 is driven back toward assembly 60*a* thereby driving assemblies 52 and 54 back over carriage 50. End 260 is disconnected from assembly 60*d'* and assemblies 52 and 54 are secured to carriage 50 in any manner known in the art.

To prepare system 48 for transport, members 164 are removed and members 70 and 72 are retracted under carriage 50 to decrease the distance between assemblies 52 and 54. Once in the retracted configuration (see FIG. 5), members 164 are inserted in appropriate apertures to lock assemblies 52 and 54 together. Once locked in the retracted configuration, system 48 can be moved to another construction cite for similar use.

Thus, the present invention includes a system 48 which is particularly useful for moving girders and other heavy construction equipment and items to and from at a construction cite. Assemblies 52, 54, 168, 169, 59, etc., cooperate to provide a safe, simple and cost effective way of moving items at construction cites which is particularly useful in the railroad industry.

C. Additional Features

While a preferred embodiment of the present invention has been described above, other advantageous features and system enhancements are contemplated which can increase the usefulness of the inventive erection system appreciably.

For example, referring to FIG. 19, in addition to providing train trucks 61 (only one shown) below carriage 50, two or more tire trucks 350 (only one shown) may be provided below carriage 50 also, the tire trucks 350 equispaced along the bottom surface of carriage 50 and preferably adjacent train trucks 61. Each tire truck 350 includes four separate tires (only two shown) two tires 354, 356 below each side of carriage 50. Each truck 350 also includes an extendable post 358 and a jacking mechanism 360. Jacking mechanism 360 is typically a hydraulic pump/motor assembly. Post 358 extends down from mechanism 360 and is secured to a horizontal member 362 which is in turn secured to tire axles supporting tires 354 and 356.

It is contemplated that jacking mechanism 360 and post 358 can be used to move tires 354 and 356 between a retracted position (illustrated) and an extended position (illustrated in phantom). When in the retracted position, tires 354 and 356 are pulled close to the underside of carriage 50 and the train wheels 64 of truck 61 extend downwardly further than tires 354 and 356 such that carriage 50 is supported on wheels 64. When in the extended position (illustrated in phantom), tires 354 and 356 extend downwardly further than wheels 64 and therefore carriage 50 is supported by wheels 354 and 356.

Dual tire/train trucks enable transport of crane system 48 off of a conventional train track. This ability is advantageous for at least two purposes. First, all of the advantages of using the inventive crane system 48 to deconstruct and build railroad bridges are also advantageous in deconstructing and building other types of bridges such as bridges used by automobiles. A tractor truck could easily be used to move crane system 48 into a position adjacent an automobile bridge for such purposes. Second, there may be times when it would be advantageous to remove crane system 48 from a railroad track while still keeping system 48 near a bridge which is being revamped. For example, with a relatively long bridge it may be desirable to remove and replace half of the bridge, remove the crane assembly from the track, let railroad traffic pass over the bridge and thereafter remove and replace the remainder of the bridge.

Figure 20:
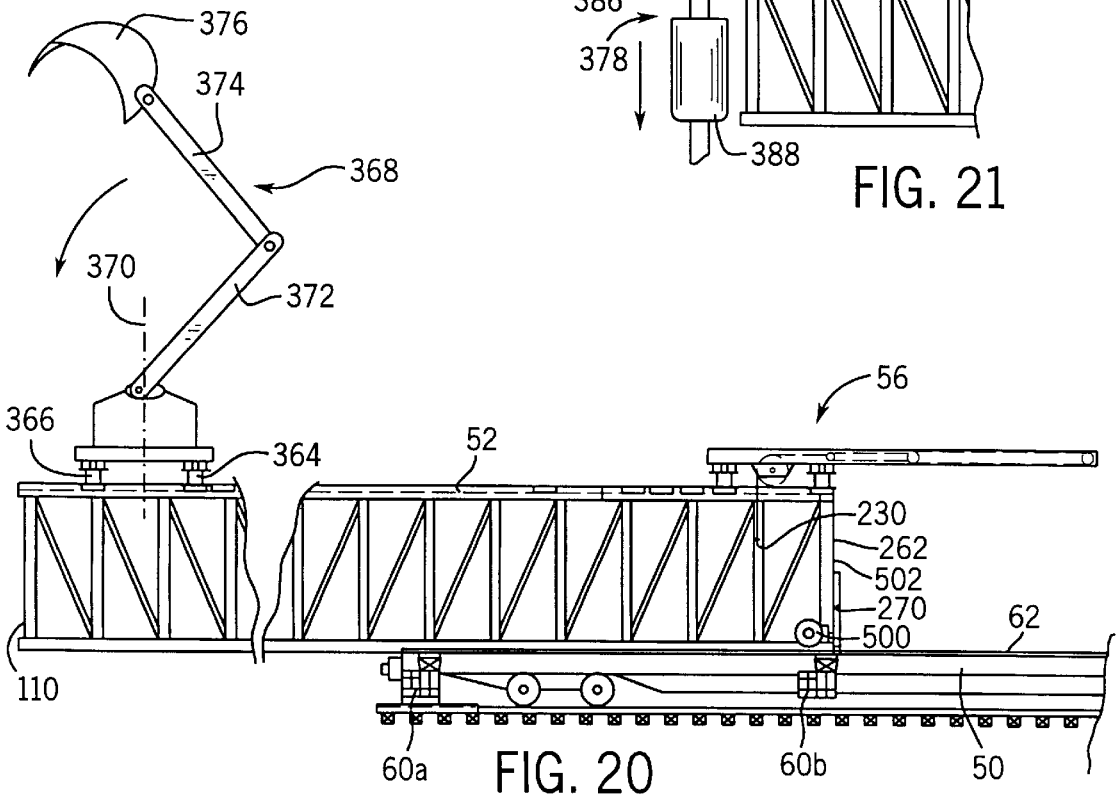
FIG. 20 is a side elevational view of an inventive truss assembly having an excavation arm attachment.

Referring now to FIG. 20, in addition to providing lifting assemblies 56 above truss assemblies 52 and 54, other tool apparatuses may be provided on support beams 364 and 366 for movement along the tops of trusses 52 and 54. For example, as illustrated, an excavation arm assembly 368 may be provided on support beams 364 and 366, arm 368 rotatable about an axis 370 and including two extension members 372 and 374 and an excavation bucket 376 for extending downward below track level to pick up debris.

Figure 21:
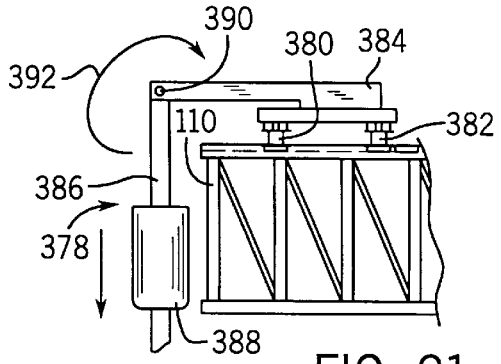
FIG. 21 is a view of a pile driver attachment secured to an inventive truss assembly.

Similarly, referring to FIG. 21, instead of a lifting assembly 56 or an excavation arm 368, a pile driver assembly 378 may be provided on support members 380 and 382. Driver 378 includes a horizontal extension 384, another extension 386 linked to a distal end of extension 384 and the pile driver mechanism 388 linked to a distal end of member 386. Assembly 378 is used to drive piles into the earth for bridge pylons or the like. It is contemplated that, when not in use, mechanism 388 and member 386 could rotate about a pivot pin 390 in the direction indicated by arrow 392 so that mechanism 388 and extension 386 would be positioned above beam 110 for storage and transport.

Figure 22:
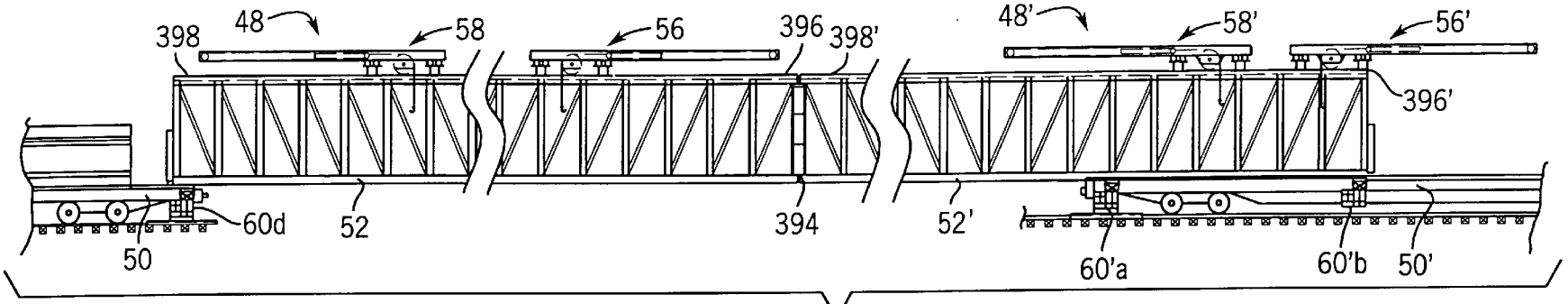
FIG. 22 is a side elevational view of first and second truss assemblies linked together to form an extended assembly.

Referring now to FIG. 22, in addition to using a single crane assembly 48 for moving materials and building or destroying bridges, it is contemplated that two or more crane assemblies could be used in conjunction to increase the span between supporting carriages. In FIG. 22, components corresponding to a second crane assembly are identified by identical numerals as components corresponding to a first crane assembly albeit followed by a prime "'". For example, while a first crane assembly is identified by numeral 48, a second crane assembly is identified by numeral 48' and so on.

Figure 24:
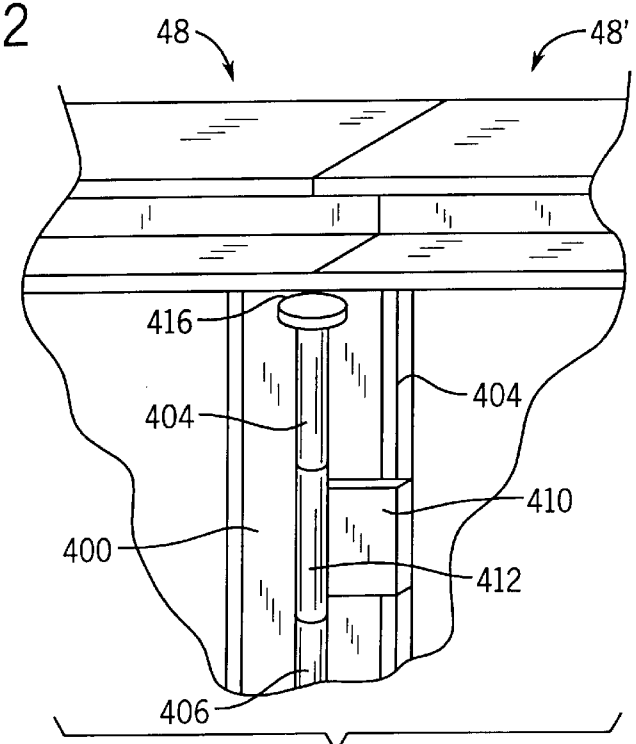
FIG. 24 is similar to FIG. 23, albeit with the coupling assembly coupled together.
Figure 23:
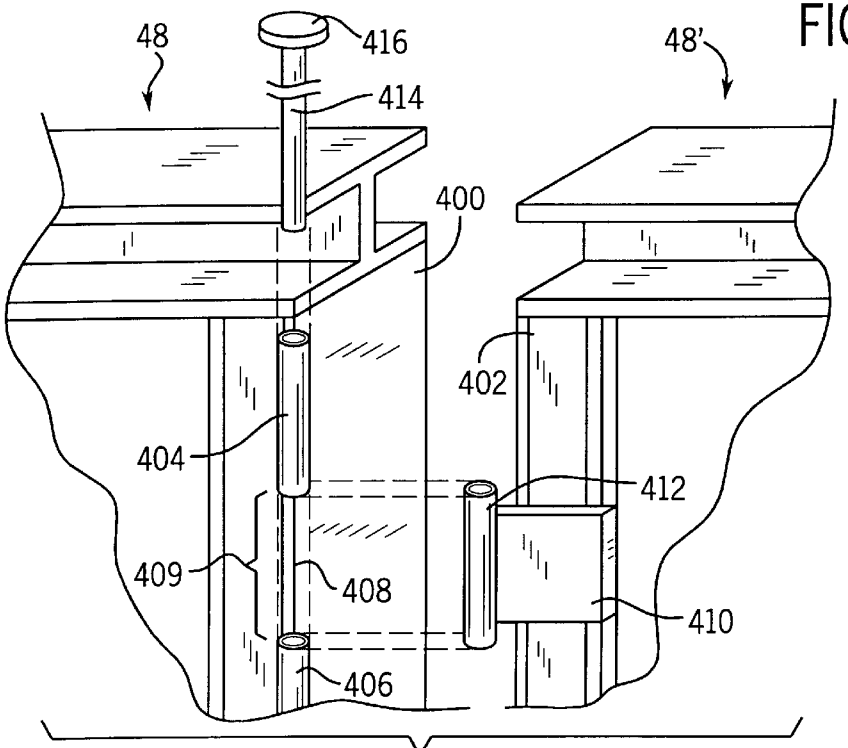
FIG. 23 is a blow-up view of the coupling assembly of FIG. 22 in an uncoupled state.

In order to use two crane assemblies 48, 48' together, a coupling assembly 394 is provided to couple a fore end 396 of assembly 48 and a rear end 398' of assembly 48' together. While any secure and robust coupling mechanism could be used to couple the fore and rear ends 396 and 398' together, an exemplary coupling mechanism is illustrated in FIGS. 23 and 24. Referring specifically to FIG. 23, an end beam at the fore end of truss 52 is identified by numeral 400 and an end beam at the rear end 398' of truss 52' is identified by numeral 402. In this embodiment, the coupling mechanism includes a first coupler linked to beam 400 and a second coupler linked to beam 402 to secure trusses 52 and 52' together. Referring also to FIG. 12, although not illustrated, similar couplers are provided on truss 54 of assembly 48 and a similar truss on assembly 48' to couple those trusses together.

Referring to FIG. 23, the first coupler includes a plurality of steel cylinders 404, 406 (only two shown) which are securely welded to beam 400 along a coupling axis 408. As illustrated, cylinders 404 and 406 are welded to beam 400 such that they extend laterally therefrom and are not between beams 400 and 402. Cylinders 404, 406, etc., are spaced apart along axis 408 so that intervening spaces (one identified by numeral 409) are provided between adjacent cylinders 404, 406.

Referring still to FIG. 23, the second coupler assembly is secured to beam 402 and includes a plurality of extension plates 410 (only one shown) which are securely welded to a lateral portion of beam 402, each extension plate 410 including a distal end which extends toward axis 408, a separate steel cylinder 412 (only one shown) is welded to each of the plate distal ends. The plates 410 are mounted to beam 402 such that cylinders 412 will be received within spaces 409 and will align along axis 408 with cylinders 404 and 406 when assemblies 48 and 48' are brought together such that fore beam 400 and rear beam 402 contact. A securing rod 414 is provided. Rod 414 includes a head or stop member 416 and an elongated member which is receivable securely within cylinders 404, 406 and 412.

Referring now to FIGS. 23 and 24, to secure assemblies 48 and 48' together, assemblies 48 and 48' are moved together until beams 400 and 402 contact. At this point, cylinder 412 should be positioned within space 409 and aligned with axis 408 and cylinders 404 and 406. Then, rod 414 is slid though cylinders 404, 412 and 406 thereby securing beams 400 and 402 together. Similarly, a rod is slid though aligned cylinders between truss 54 and an associated truss opposite truss 52' to secure those trusses together. If desired, similar cylinders can be welded to the internal portions of beams 400 and 402 to provide further support. While a single coupling assembly has been illustrated and described, the present invention should not be so limited and could include any type of secure and robust coupling assembly.

Figure 19:
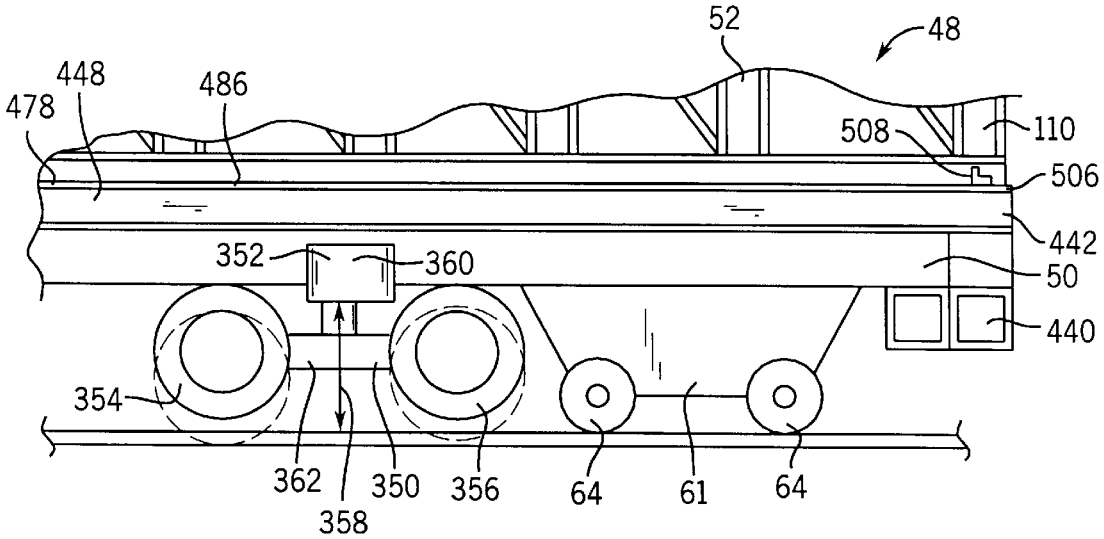
FIG. 19 is a side perspective view of a preferred truck configuration according to one embodiment of the present invention.
Figure 25:
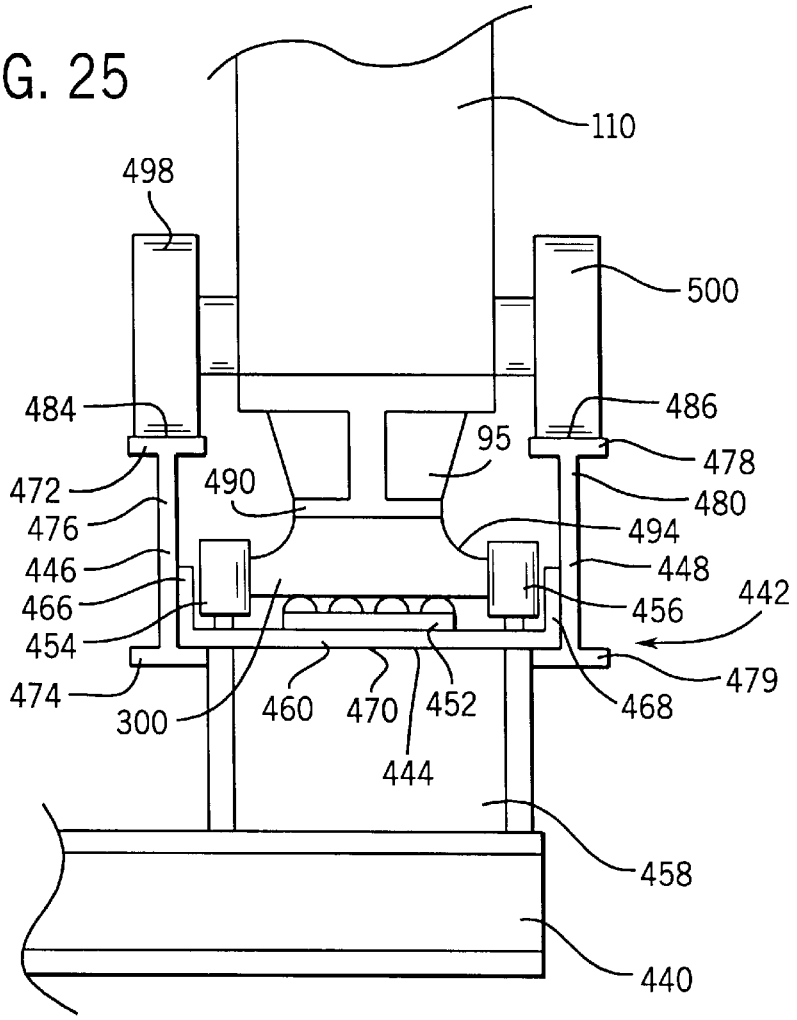
FIG. 25 is a partial enlarged end view of the guide beam of FIG. 19.
Figure 26:
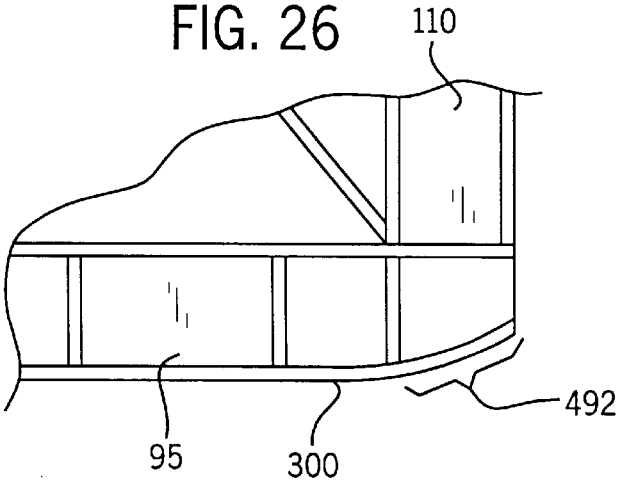
FIG. 26 is a partial enlarged side elevational view of a bottom end of the glide beam of FIG. 25.
Figure 32:
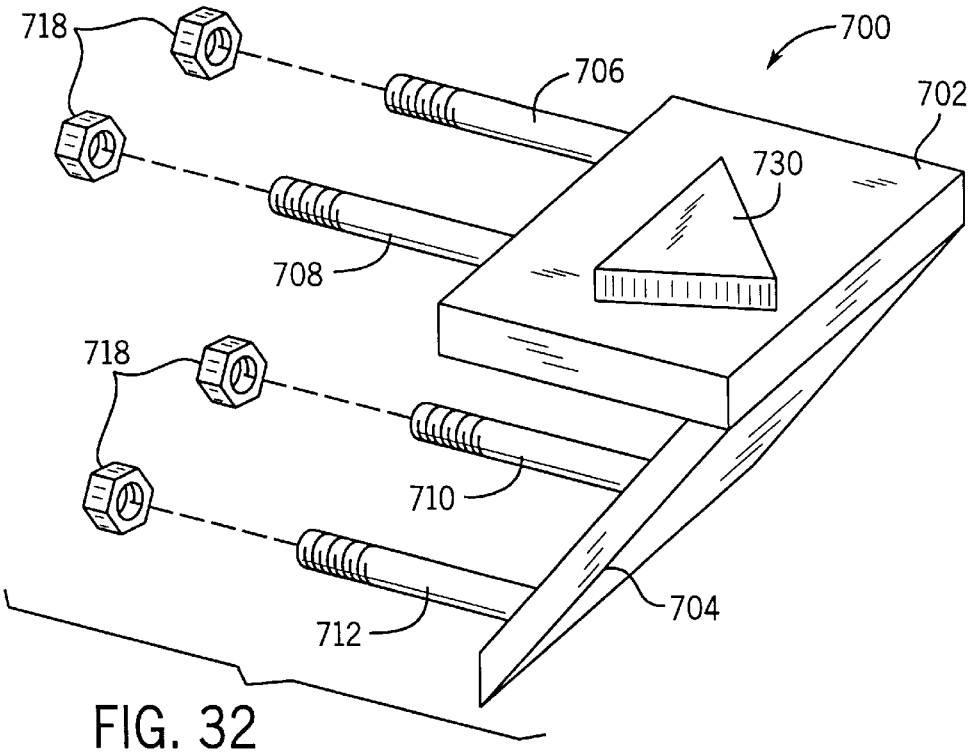
FIG. 32 is a perspective view of a mechanical support mechanism of FIG. 31.

Referring now to FIGS. 19, 25 and 26, a preferred configuration for mounting a glide beam 110 to support members 440 (one shown) is illustrated. In this embodiment, a guide beam assembly is provided for guiding glide beam 110 and for linking the distal ends of support members 440. The guide beam assembly is identified by numeral 442 and generally includes a U-shaped beam 444, first and second I-beams 446 and 448, a plurality of ball bearings 452 (only one shown) and a plurality of rollers 454 and 456 (only two shown).

A base member 458 extends upwardly from the distal end of support member 440 to a height such that a top surface 460 of member 458 is vertically higher than a top surface 462 of a carriage deck 464 (see FIG. 27). Member 458 ensures that, even when support members 440 are retracted to the full extent, the glide beams supported thereby can still move lengthwise above the lateral portions of deck 464.

U-shaped member or beam 444 includes first and second lateral members 466 and 468 and a transverse member 470 which traverses the distance between members 466 and 468. The undersurface of transverse member 470 is welded to the top surface 460 of member 458 such that members 466 and 468 extend upwardly. The ball bearings 452 (only one shown) are mounted to a top surface of transverse member 470 and are equispaced along the length of member 470. For example, a typical assembly may include 4 or 5 ball bearings 452 equispaced along the length (i.e. extending into FIG. 25) of member 470.

In addition, a plurality of roller pairs, each pair including two rollers (e.g. 454 and 456) extend upwardly from the top surface of member 470. Each roller 454 and 456 is mounted on a vertical axis which is perpendicular to the gliding direction (i.e. into and out of FIG. 25) of beam 110. Preferably, a separate roller paired 454, 456 is provided for each ball bearing 452, a separate roller 454 and 456 provided on each side of an associated ball bearing 452. A distance between a roller pair 454, 456 is essentially equal to the width of a bottom member 300 of beam 95.

I-beam 446 includes a top member 472, a bottom member 474 and a transverse member 476 which traverses the distance between members 472 and 474. Similarly, I-beam 448 includes a top member 478, a bottom member 479 and a transverse member 480 which traverses the distance between members 478 and 479. A lower portion of transverse member 476 is welded to an external surface of member 466. Similarly, a lower portion of member 480 is welded to an external surface of member 468. When so welded, top member 472 forms a top surface 484 which faces upwardly and top member 478 forms a top surface 486 which also faces upwardly.

In this embodiment, glide beam 110 includes a bottom beam 95 having a bottom member 490 which forms a bottom surface 300, bottom member 490 receivable between rollers 454 and 456 and supportable on ball bearings 452. Importantly, referring to FIGS. 25 and 26, at each end of member 490, member 490 curves upwardly (see generally 492). In addition, the lateral edges of member 490 at each end of member 490 taper inwardly (see 494). This tapering and curving helps to guide member 490 into a position between rollers 454 and 456 and above and supported by ball bearings 452.

In addition, referring to FIGS. 20 and 25, a pair of relatively large rollers 498, 500 are mounted to an axle which is secured to a rear end 502 of beam 110. A similar pair of rollers (not illustrated) is mounted to the other glide beam. Rollers 498 and 500 are mounted to a lower portion of the rear end of beam 110 such that roller 498 rests on top surface 484 and roller 500 rests on top surface 486, rollers 498 and 500 supporting a large portion of beam 110 weight. Moreover, referring to FIG. 19, at a fore end 506 of I-beams 446 and 448, separate roller stops 508 (only one shown) are provided on top surfaces 484 and 486, respectively. Stops 508 limit movement of rollers 498 and 500 as the glide beams are pulled outwardly via a second railroad car. Similarly, stops like stop 508 may also be provided on top surfaces 484 and 486 at the rear ends of I-beams 446 and 448.

Referring still to FIGS. 19 and 25, by providing rigid guide beam assemblies 442 which are securely mounted to the distal ends of support members 440, the glide beams can easily be glided along their length in and out of the guide assemblies, different portions of the guide assemblies always aligned due to the stiffness of the guide assembly generally and specifically the U-shaped beams 470 which have their relatively strong transverse members aligned with the direction of support member 440 movement.

Referring now to FIGS. 27, 28 and 29, the present invention also includes control circuitry for facilitating smooth lateral opening and closing of the inventive crane assembly. To this end, instead of simply forcing the top of the crane assembly 48 open and closed by forcing support members 440 and 510 outwardly and inwardly, it is preferred to use a motor linked to one end of each top supporter beam to control the distance between the top portions of the glide beams. Thus, as seen in FIG. 27, assembly 48 includes a carriage having a deck 464, support members 440 and 510 which extend laterally therefrom, motors 512 and 514 for controlling lateral movement of members 510 and 440, respectively, guide beam assemblies 516 and 518, glide beams 520 and 522, supporter beams 524 (only one shown), and motors 526 and 528 for moving associated supporter beam ends along the tops of beams 520 and 522.

Each of motors 512 and 514 are mounted below deck surface 462 and are linked to support members 510 and 440 for moving those members laterally. Assemblies 516 and 518 are secured to the distal ends of members 510 and 440 and support beams 520 and 522 in essentially vertical orientations there above, respectively. Thus, the lower ends of beams 520 and 522 move laterally as the distal ends of members 510 and 440 move laterally.

Beam 524 is mounted at a first end 530 to the top end of beam 520 and is mounted as second and 532 to the top end of beam 522. Referring also to FIG. 12, beam 524 is mounted, like beam 169 such that when the crane assembly is in a retracted configuration, beam 524 is angled with respect to the glide beams, and when in an expanded configuration, beam 524 is essentially perpendicular to the glide beams. As illustrated in FIG. 27 the crane assembly is in an intermediate position where it is partially expanded and therefore beam 524 forms an angle with glide beams 520 and 522. To increase the distance between the top portions of beams 520 and 522 a preferred method includes locking motor 526 so that beam end 530 is stationary with respect to glide beam 520 and using motor 528 to move beam end 532 along the top of glide beam 522 thereby causing beam 524 to be relatively more perpendicular to beams 520 and 522 from a top perspective. Similarly, motor 528 may be locked while motor 526 is used to move beam end 530 along the top of beam 520.

Thus, generally, with motor 526 locked, three separate motors 512, 514 and 528 (or motors 512, 514 and 526) have to be controlled in order to expand both the top portions and the bottom portions of beams 520 and 522 to expand the crane assembly. Similarly, all three motors 528, 512 and 514 have to be controlled to retract the top and bottom portions of beams 520 and 522.

According to the present invention, a processor 550 is provided to correlate and synchronize opening of the top and bottom portions of crane assembly 48. In addition, position sensing devices are also provided to indicate the positions of support members 510 and 440 and to indicate the relative position of motors 526 and 528 which in turn can be used to identify the distance between the top portions of beams 520 and 522.

Referring still to FIG. 27, the sensors to sense the positions of support members 510 and 440 are essentially identical and therefore only the sensor associated with member 440 is described here in detail in order to simplify this explanation. The position sensor for member 440 includes a light sensor 552 and a reflective strip 554. The strip 554 includes equispaced reflector elements separated by opaque elements. Sensor 552 includes a light source and a light sensor. Strip 554 is mounted to a top surface of member 440 and sensor 552 is mounted to deck 464 adjacent strip 554 so that the light source is pointed toward strip 554. When light subtends a reflective element of strip 554 the light is reflected back into the sensor. However, when light subtends an opaque element of strip 554 no light is reflected back. Thus, as member 440 is retracted and extended, sensor 552 generates a pulsing signal indicating reflection which can be used to determine member 440 position. Referring to FIGS. 27 and 29, sensor 552 is linked to processor 550 and provides a first sensor signal $\zeta_1$. A similar signal $\zeta_2$ is provided by a sensor 556 mounted to the other side of deck 464. Signals $\zeta_1$ and $\zeta_2$ can be used by processor to determine the positions of members 440 and 510 and hence to determine the distance between the lower portions of beams 520 and 522.

Processor 550 is also linked to a transceiver 558 which can receive RF signals from various devices and can send RF signals to various devices for feedback and control purposes. Transceivers are well known in the above-controls art and therefore will not be explained here in detail. Each of motors 526 and 528 is also equipped with an RF transceiver 560 and 562, respectively for sending and receiving signals.

Although not illustrated, each of motors 526 and 528 may be equipped with a sensor similar to sensor 552 which, in conjunction with a reflective strip along the length of as associated beam 520 or 522, can determine the precise position of the motor. These positions can then be provided via RF and transceivers 560, 562 and 558 to processor 550 so that processor can determine the distance between the top portions of beams 520 and 522. Thus, if motors 526 and 528 are at the same locations along the length of their respective beams 520 and 522, processor 550 determines that the distance between beams 520 and 522 is equal to the length of beam 524. If the relative positions of motors 526 and 528 are separated by two feet, processor 550 determines a different yet precise distance between beam 520 and 522 which is less than the length of beam 524.

In addition to receiving signals from sensors 556 and 552 and transceivers 560 and 562, processor 550 also provides signals to motors 512, 514, 526 and 528. Processor 550 is hardwired to motors 512 and 514 providing control signals $S_1$ and $S_2$ thereto. Processor 550 sends signals to motors 560 and 562 via transceiver 558 and RF signals.

Referring to FIG. 28, a remote control device 570 for controlling processor 550 is illustrated. Device 570 includes a housing 572, a transceiver 574, right and left control knobs 576 and 578, a plurality of control buttons arranged to form a keypad 580 and a processor (not illustrated) linked to knobs 576 and 578 and keypad 580 for receiving command signals and also linked to transceiver 574 for transmitting RF command signals to transceiver 558. Although device 570 can be used for various other purposes, it will only be explained in the in context of laterally opening and closing crane assembly 48. To this end, knob 576 is used to extend support member 440 to the right and at the same time to open the top portion of assembly 48 essentially an identical amount. Similarly, knob 578 is used to expand and retract the lefthand portion of assembly 48.

To open the righthand side of assembly 48, knob 576 is pushed to the right. When this occurs, device 570 sends an RF signal to transceiver 558 and thus to processor 550. When processor 550 receives the signal, processor 550 sends a command signal $S_1$ to motor 514 causing motor 514 to drive member 440 toward an extended position. In addition processor 550 also sends an RF signal to motor 528 indicating that motor 528 should move in a direction to align motors 526 and 528 (i.e. to increase the distance between the top ends of beams 520 and 522). As each of motors 528 and 514 are operating, the sensors associated with motor 528 position and beam 440 position (i.e. sensor 552) provide feedback signals to processor 550. Processor 550 then calculates the distance between the top portions of beams 520 and 522 from the relative positions of motors 526 and 528, calculates the distance between the bottom portions of beams 520 and 522 via signals $\zeta_1$ and $\zeta_2$ and then compares the distances between the top and bottom portions of beams 520 and 522. Where there is a difference between the distances between the top and bottom portions of beams 520 and 522, processor 550 adjusts operation of motors 528 and 514 accordingly thereby maintaining essentially vertically upright beams 520 and 522.

Similarly, to move the lefthand side of assembly 48 outwardly, an operator would push knob 578 to the left. When this occurs, processor 550 causes motors 512 and 526 to operate in an synchronized fashion to increase the distance between beams 520 and 522 yet maintain a constant distance between the top and bottom portions of those beams. While this is occurring, motor 528 is stationary.

To retract beams 520 and 522, knobs 576 and 578 are simply pushed in the opposite directions thereby causing processor 550 to operate motors 512, 514, 526 and 528 in a reverse manner.

Referring now to FIGS. 12 and 27, it should be appreciated that most assemblies according to the present invention will include more than a single supporter beam 524 (see 168, 169, 168' and 169' in FIG. 12). Similarly, referring to FIGS. 7 and 27 it should be appreciated that most assemblies according to the present invention will include more than a single pair of support members 440 and 510 (see 60*a*, 60*b*, 60*c* and 60*d*). Thus, processor 550 will be equipped to control motors or drivers associated with each of the support members and with each of the supporter beams and should be equipped to synchronize control and operation of all of those motors to facilitate smooth retracting and expanding of crane assembly 48.

It should be appreciated that while conventional stepper motors may be used to expand and retract assembly 48, other types of drives such as hydraulic driving mechanisms may also be used, the important aspect of the automatic synchronized and control system being that all of the drivers are synchronized to open and close the crane assembly in a smooth manner.

In yet another aspect of the invention, it is contemplated that some type of lifting mechanism can be provided between the distal ends of support beams 77 and 78 and glide beams 110 and 301 which can be used to hoist glide beams 110 and 301 to relatively higher positions such that the vertical distance between deck 62 (see FIG. 6) and lifting mechanism 170 is greater. In some designs the height increase may only be a few inches while in other applications the increase may be several feet.

To this end, referring to FIGS. 30 through 33, one preferred embodiment of the invention including a system for lifting glide beams 110 and 301 is illustrated. In the illustrated embodiment, the support members 77, 78, glide beams 110, 301, guide beams 442, support beams 169, deck 62 and so on are essentially identical to similarly numbered system components described in detail above and therefore, will not be explained again here.

Figure 30:
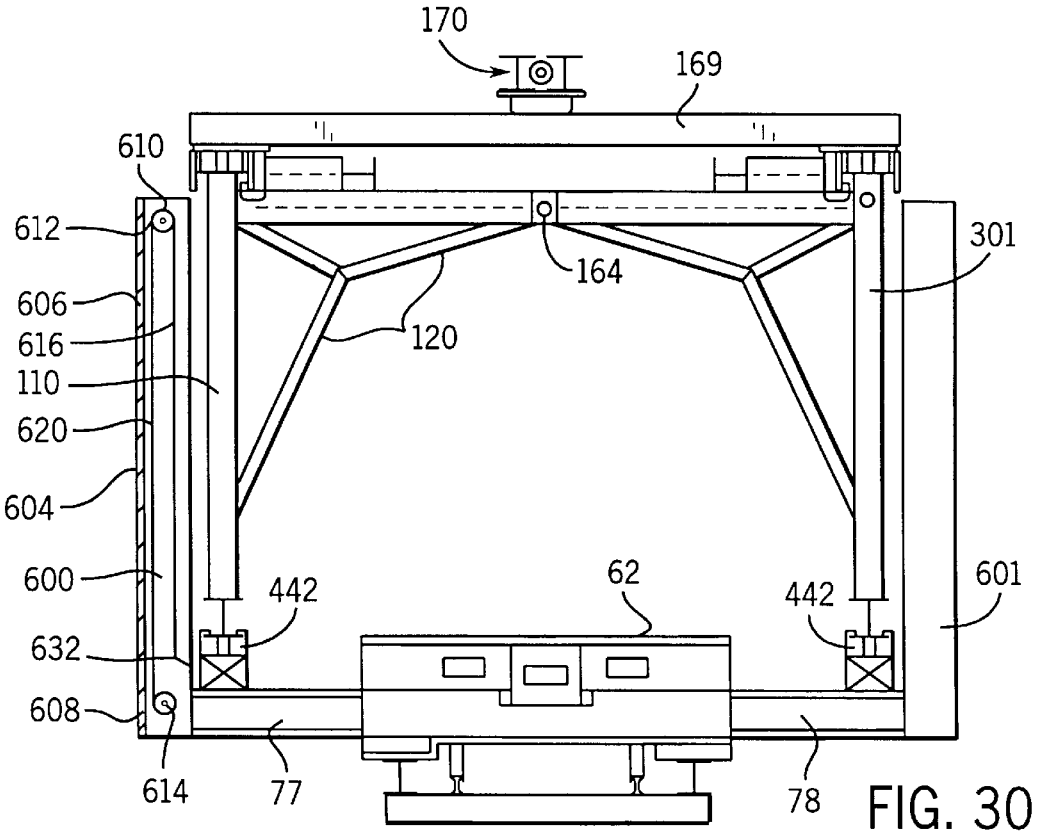
FIG. 30 is similar to FIG. 6, albeit including a vertical lifting assembly according to another aspect of the present invention.

Referring specifically to FIG. 30, in this embodiment, instead of securing guide beams 442 (see also FIG. 25) directly to the distal ends of support members 77 and 78, lift assemblies 600, 601 are secured between each support member distal end and an associated guide beam 442. Thus, referring to FIGS. 7 and 30, where there are four support assemblies 60*a* through 60*d*, there are four of each assembly 600 and 601, a separate assembly 600 and 601 for each support assembly 60*a* through 60*d*. Assemblies 600 and 601 are essentially identical and therefore only one of assemblies 600 will be explained in detail.

Figure 33:
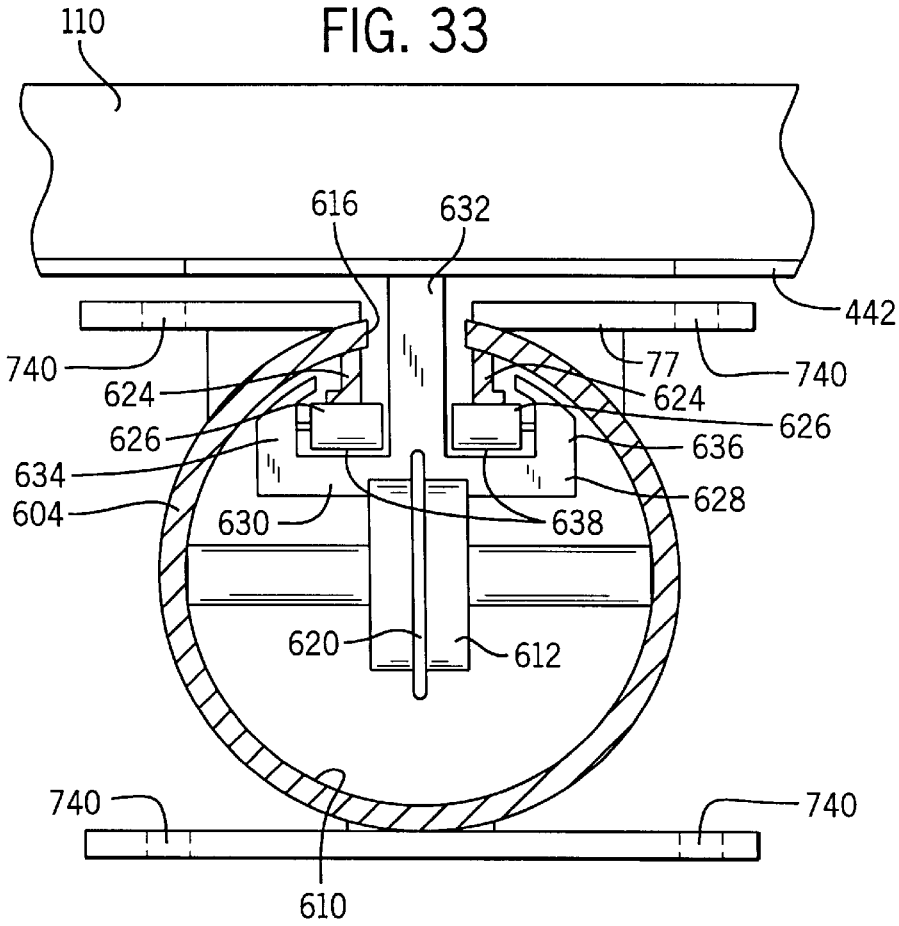
FIG. 33 is a top plan view of the vertical lifting assembly of FIG. 30.

Referring still to FIGS. 30 and 33, assembly 600 includes a vertical extension beam 604 having upper and lower ends 606, 608, respectively, and a length which is essentially equal to the depth (i.e. vertical dimension) of glide beam 110. Beam 604 forms an internal channel 610 in which a pulley 612 is mounted at upper end 606. A motor shaft 614 is mounted at lower end 608 within channel 610. Beam 604 is secured at its lower end 608 to the distal end of member 77 and forms a slot 616 along its length which faces glide beam 110. A track 624 extends inwardly from surface 610 on each side of slot 616, each extension including a lateral extension 626.

A race 628 includes a base member 630, an extension member 632 which extends perpendicular to base member 630 and is secured to guide beam 442, two arm members 634 and 636 and wheel assemblies 638. Members 634 and 636 extend around lateral extensions 626 holding race 628 adjacent track 624. Wheel assemblies 636 are mounted between members 634, 636 and member 632 such that they ride on lateral extensions 626. A lifting cable 620 is linked at a first end to shaft 614, extends up and over pulley 612 and then down to a second end which is linked to race assembly 628.

Figure 31:
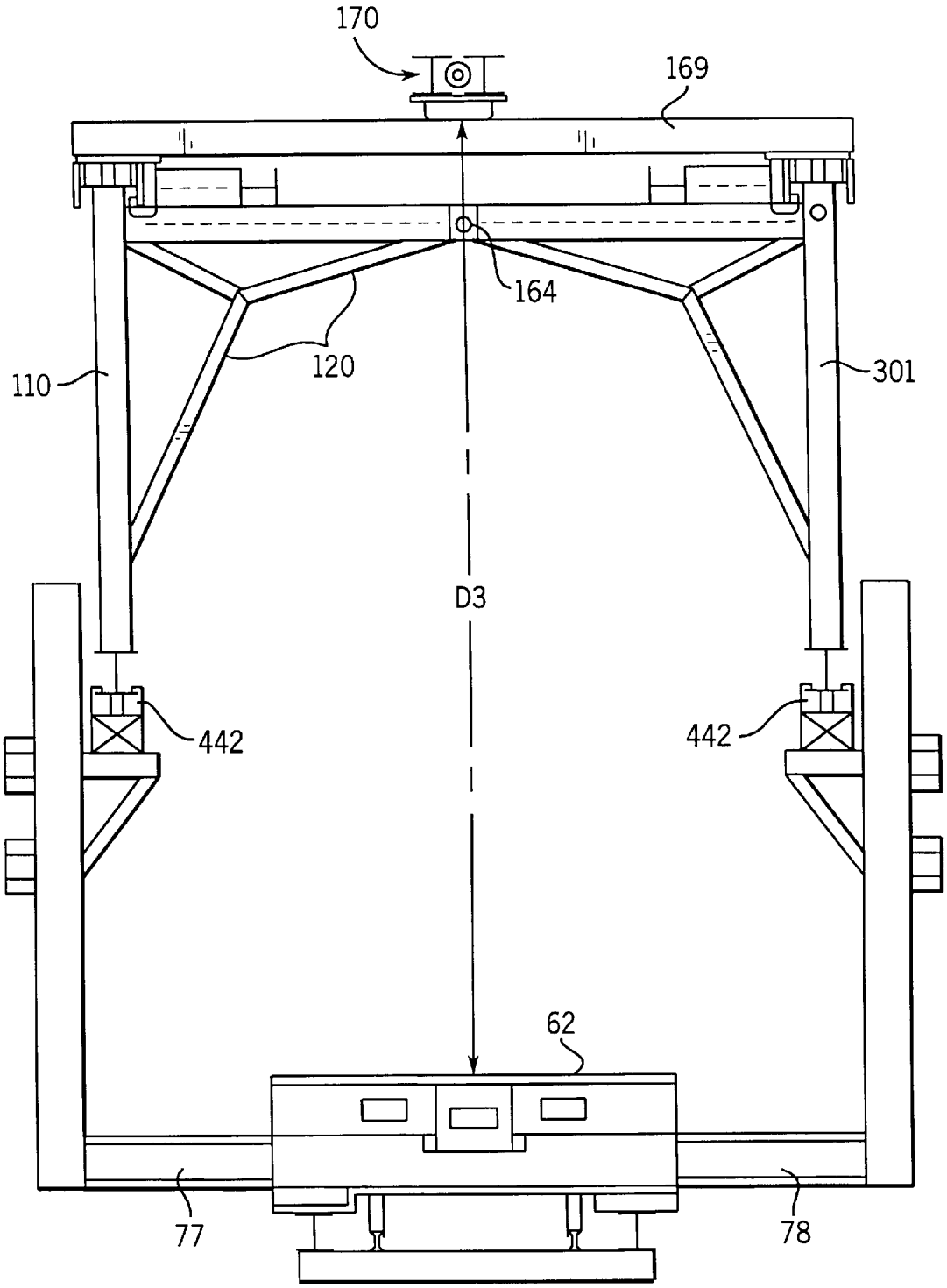
FIG. 31 is similar to FIG. 30, albeit with the vertical lifting mechanism in a vertically extended position.

Thus, it should be appreciated that as cable 620 is wound around shaft 614, race assembly 628 is raised thereby raising guide beam 442 and glide beam 110. Referring also to FIG. 31, the inventive system in a raised configuration is illustrated and the large vertical distance D3 between deck 62 and lifting assembly 170 should be noted.

Preferably, a mechanical support mechanism is provided to maintain the inventive system in the vertically extended position. To this end, referring to FIGS. 31 and 32, a preferred mechanical support 700 is illustrated. Support 32 includes a horizontal member 702 and an angled member 704 which is welded to the horizontal member 702. Two bolt ends 706, 708 extend from a rear end of member 702. Similarly, two bolt ends 710, 712 extend from a rear end of member 704. Four nuts 718 are provided, one nut 718 for each bolt end.

Referring also to FIG. 33, locking plates 720, 722 are welded to beam 604 which are parallel to guide beam 442 and, although not illustrated, extend the length of beam 604. Each plate 720, 722 forms a series of spaced apertures 740 along its length for receiving bolt ends 706–712. Keyed members 730 (one illustrated in FIG. 32) extend upward from a top surface of member 702, and are received in similar recesses (not illustrated) in the undersurface of beam 442 when the system is assembled.

In operation, after transporting the inventive system to a workplace, to raise glide beams 110, 301 to a desired height, shafts 614 are cranked until beams 110 and 301 are just above the desired height. With beams 110 and 301 held by cables 620, workmen secure assemblies 700 to each of beams 604 via bolt ends 706–712, apertures 740 and nuts 718. Then shafts 614 are reversed until beams 442 rest on member 702 (see FIG. 31).

It should be understood that the apparatuses described above are only exemplary and do not limit the scope of the invention, and that various modifications could be made by those skilled in the art that may fall under the scope of the invention. For example, while the hoist assemblies 56 and 58 described above are preferred, clearly any types of hoist mechanism could be employed. In addition, while there are two hoist assemblies, the system would still be useful if there were only a single assembly. Moreover, while the invention is described as having two configurations, extended and retracted, clearly other intermediate configurations would be possible. To this end, a plurality of apertures could be provided in each of beams 118, 127, 119 and 128 so that those beams could be locked in any of several different configurations to provide several different distances between assemblies 52 and 54.

It should also be noted that the inventive system could easily be equipped with locomotive capabilities so that it could move itself and an additional supply car to and from construction sites. Moreover, the present invention could clearly be used in industries other than the railroad industry.

Also, importantly, the mechanisms used to move assembly 59, assemblies 52 and 54, assemblies 168 and 169 and assemblies 56 and 58 could be any of a plurality of well known motivation mechanisms used in the art and should not be limited to the mechanisms described herein. Furthermore, while the invention preferably includes lateral extension assemblies which extend to both sides of carriage 50, the invention could be practiced wherein the extensions extend to only a single side and assemblies 52 and 54 are moveable therealong. Moreover, while the invention is described as having four assemblies 60*a* through 60*d*, clearly the invention could be practiced wherein there are one, two, three or some other number of assemblies, depending on stability requirements.

In addition, referring to FIG. 3 and as suggested above, the upper surface 62 of the deck 50 may be equipped with a plurality of rollers that rotate about axes that are parallel to the upper surface 62 and perpendicular to the length of the deck 50. To withstand the weight of a construction item, the rollers should be constructed of steel and supported on solid, thick axles. The external surface of each wheel may be provided with a rubber sheath in order to minimize slippage between the wheel and a girder thereon. When so equipped, a girder can be placed on deck 62 and rolled from one end of the deck to the other to alleviate strain on the system components.

Furthermore, referring to FIG. 12, while a preferred design of the support beams 168, 169, 168' and 169' is illustrated as forming an angle with respect to glide beams 110 and 301 when the glide beams are not laterally separated, the support beams 168, 169, etc., could take any of several different forms which have a variable length component perpendicular to the length of glide beams 110 and 301. For example, the support beams may take a form which resembles the support members (see 77 and 78 in FIG. 7). In this case each support beam may include two beams, a first support beam extending toward an opposing glide beam and a second support beam extending toward the other opposing glide beam. In this case a sleeve (similar to 82 in FIG. 7) could be provided to guide the support beams adjacent each other during lateral glide beam movement. Here, to separate glide beams 110 and 301, the support beams are forced in opposite directions and toward the glide beams which the support beams are linked to. Similarly, to reduce the width between beams 110 and 301, the support beams are forced in opposite directions toward the opposite glide beams Moreover, other support beam configurations are contemplated.

In addition, which a mechanical motor assembly is described as the system for vertically lifting the glide beams 110, 301 (see FIGS. 30 and 31), other assemblies such as hydraulic assemblies are contemplated. Also, for increased stability it may be advantageous to provide a lattice beam structure between vertical lifting assemblies 600 on one side of the system and another lattice beam structure between vertical lifting assemblies 601 on the other side on the system. Moreover, it would likely be advantageous to provide a vertically expanding system even where lateral expansion could not be facilitated. Thus, another preferred system may only include vertically expanding hardware as in FIGS. 30 and 31 without lateral expansion.

To apprise the public of the scope of this invention the following claims are made.

I claim:

1. A method for use with a crane apparatus having a carriage including a deck and at least one truck mechanism connected to an undersurface of the deck, the deck including forward and rearward edges and first and second lateral edges, at least one support member having a distal end, the support member mounted to the deck such that the distal end is laterally extendable from the first edge, first and second glide beams, the first beam coupled to the distal end for movement along a movement axis parallel to a first beam length, the second beam coupled to the deck so as to be essentially parallel and spaced apart from the first beam and for movement essentially parallel to the movement axis, at least one support beam having first and second ends, the first end coupled to the top of the first glide beam and the second end coupled to the top of the second glide beam, the support beam having a variable length component perpendicular to the first glide beam length, the method for setting up the crane apparatus for operation above a work space adjacent the front edge, with the front edge adjacent the work space, the method comprising the steps of:

moving the support member from a retracted position wherein the distal end of the support member is adjacent the first lateral edge to an extended position wherein the distal end is separated from the first lateral edge; and moving the glide beams parallel to the movement axis relative to the carriage such that at least a portion of the glide beams is positioned above the work space.

2. The method of claim 1 wherein the support beam is linked to the portion of the beams which is positionable above the work space, the apparatus further includes at least one tool apparatus linked to the support beams, the method is also for performing a task within the work space and further includes the step of using the tool apparatus to perform work within the work space.

3. The method of claim 2 wherein the supporter is moveable along the glide beam tops and 3 wherein the method further includes the step of, prior to using the tool apparatus, moving the supporter to a position above the work space.

4. The method of claim 2 wherein the tool apparatus includes at least one lifting mechanism coupled to the support beam, the lifting mechanism including a strand having upper and lower ends and a connector connected to the lower end and, wherein, the method is also for moving an object within the work space, the step of using further including the steps of lowering the connector, linking the connector to the object and raising the connector.

5. The method of claim 2 wherein the tool apparatus includes a pile driver and wherein the method is also for driving a pile positioned within the work space and wherein the step of using includes driving at least one pile in the work space.

6. The method of claim 2 wherein the tool apparatus includes an excavation arm and wherein the step of using includes using the excavation arm to excavate within the work space.

7. The method of claim 1 wherein the support member is a first support member and the apparatus further includes a second support member having a distal end and mounted to the deck such that the distal end is laterally extendable from the second edge, the second glide beam coupled to the second support member distal end for movement along the movement axis and, wherein the step of moving the support member further includes moving the second support member from a retracted position wherein the distal end of the support member is adjacent the second lateral edge to an extended position wherein the distal end is separated from the second lateral edge.

8. The method of claim 7 wherein the first and second support member are a first member pair and the apparatus further includes at least a second support member pair including third and fourth support members having distal ends, the first and second pairs spaced apart along the deck length between the forward and rearward edges, the first glide beam coupled to the first and third support member distal ends and the second glide beam coupled to the second and fourth support member distal ends for movement along the movement axis and, wherein, the step of moving the support members further includes the step of moving the first and third support members synchronously and moving the second and fourth support members synchronously.

9. The method of claim 1 wherein the ends of each beam which extend from the carriage are distal ends, the opposite ends are proximate ends and the apparatus is used with a second carriage including a second truck mechanism and a second support member having a distal end which is laterally extendable and, wherein, the step of moving the beams includes extending the second support member distal end until the second support member distal end aligns with the first beam, moving the first and second beams toward the second carriage until the first beam contacts the second support member distal end and the and the second beam is adjacent the second carriage, securing the first and second beam distal ends to the second support member distal end and the carriage, respectively, and pulling the second carriage away from the first carriage until the proximate ends are adjacent the front edge of the first carriage and the work space is between the first and second carriages.

10. The method of claim 1 wherein the apparatus further includes at least one rigid locking beam and the method further includes the step of, after moving the support member laterally, linking the first and second beam tops via the locking beam which traverses therebetween.

11. A crane apparatus comprising:

(a) a carriage including a deck and at least one truck mechanism connected to an undersurface of the deck, the deck including forward and rearward edges and first and second lateral edges;

(b) at least one support member having a distal end, the support member mounted to the deck such that the distal end is laterally extendable from the first edge;

(c) first and second glide beams, the first beam coupled to the distal end for movement along a movement axis parallel to a first beam length, the second beam coupled to the deck so as to be essentially parallel and spaced apart from the first beam and for movement essentially parallel to the movement axis;

(d) at least one support beam having first and second ends, the first end coupled to the top of the first glide beam and the second end coupled to the top of the second glide beam, the support beam having a variable length component perpendicular to the first glide beam length; and (e) at least one tool apparatus linked to the support beam;

(f) wherein the support member is moveable between at least a retracted position and an extended position, when in the retracted position, the distal end adjacent the first lateral edge and when in the extended position, the distal end separated from the first lateral edge, and, wherein, the glide beams are moveable parallel to the movement axis relative to the carriage.

12. The apparatus of claim 11 further including first and second vertical lifters, the first vertical lifter coupled between the support member distal end and the first glide beam and the second vertical lifter coupled between the deck and the second glide beam wherein, the vertical lifters are positionable between extended and retracted positions, when the retracted position, the vertical lifters positioning the glide beams in a first position relative the deck and, when in the extended position, the vertical lifters raising the glide beams into a second position, when in the second position, the glide beams relatively higher above the deck than when in the first position.

13. The apparatus of claim 12 further including mechanical support mechanisms which, after the vertical lifters raise the glide beams into the second position, are linkable to the vertical lifters and include at least one member for supporting the glide beams in the second position.

14. The apparatus of claim 11 wherein the tool apparatus is a pile driver.

15. The apparatus of claim 11 wherein the tool apparatus is an excavation arm.

16. The apparatus of claim 11 wherein the support member is a first support member and the apparatus further includes a second support member having a distal end and mounted to the deck such that the distal end is laterally extendable from the second edge, the second glide beam coupled to the second support member distal end for movement along the movement axis.

17. The apparatus of claim 16 wherein the first and second support members are a first member pair and the apparatus further includes at least a second support member pair including third and fourth support members having distal ends, the first and second pairs spaced apart along the deck length between the forward and rearward edges, the first glide beam coupled to the first and third support member distal ends and the second glide beam coupled to the second and fourth support member distal ends for movement along the movement axis.

18. The apparatus of claim 11 wherein the truck mechanism includes at least first and second tire trucks, each truck including mounted tires.

19. The apparatus of claim 18 wherein the truck mechanism further includes first and second train trucks and a jacking mechanism, each of the train trucks being a first truck and each of the tire trucks being second trucks, either the first or second trucks linked to the jacking mechanism and being jackable trucks, the jacking mechanism useable to move the jackable trucks between extended and retracted positions, when in the extended position, the jackable trucks positioned such that the crane apparatus is supported by the jackable trucks and, when in the retracted position, the jackable trucks positioned such that the crane apparatus is supported by the other trucks.

20. The apparatus of claim 11 further including a first and second drivers and a controller, the first driver linked to the support member for driving the support member between the retracted and expanded positions and the second driver linked to the supporter for adjusting the distance between the first and second beam tops as the support member is driven between the retracted and expanded positions such that the beams remain essentially parallel, the apparatus further including a controller linked to the first and second drivers for synchronizing expansion and retraction of the support member distal end and the beam tops.

21. The apparatus of claim 20 wherein the support member is a first support member and the apparatus further includes a second support member having a distal end and mounted to the deck such that the distal end is laterally extendable from the second edge, the second glide beam coupled to the second support member distal end for movement along the movement axis, the first driver also linked to the second support member and the controller synchronizing movement of each of the first and second support members and the supporter such that the beams essentially remain parallel.

22. The apparatus of claim 11 wherein when the glide beams are above the deck, the bottom surfaces of the first and second glide beam ends adjacent the rear end of the deck curve upwardly.

23. The apparatus of claim 22 wherein the bottom surfaces of the of the first and second glide beam ends curve upwardly.

24. The apparatus of claim 11 wherein when the glide beams are above the deck, the lateral bottom edges of the first and second glide beam ends adjacent the rear end of the deck curve inwardly.

25. The apparatus of claim 22 wherein the lateral bottom edges of the first and second glide beam ends curve inwardly.

26. The apparatus of claim 11 further including first and second elongated and rigid guide beams, the first guide beam linked to the distal end of the support member and the second guide beam linked to the deck, the first and second glide beams linked to the first and second guide beams, respectively, for movement therealong.

27. The apparatus of claim 26 wherein a distal end of each glide beam is extendable form the front end, the other glide beam end being a proximate end, the apparatus further including, for each glide beam, at least one roller linked to the glide beam proximal end and supported on a top surface of an adjacent guide beam for movement therealong.

28. The apparatus of claim 26 wherein each guide beam forms an upwardly opening channel which is open at both ends of the guide beam and the lower ends of the first and second glide beams are received for movement in the first and second guide beam channels.

29. The apparatus of claim 28 wherein the channel forms an upwardly facing surface and the apparatus further includes at least one roller exposed on the upwardly facing surface and arranged about an axis which is perpendicular to the direction of glide beam length, the rollers supporting the glide beams thereon.

30. The apparatus of claim 29 wherein the roller includes a plurality of rollers essentially equispaced along the upwardly facing surface length.

31. The apparatus of claim 30 further including at least one pair of lateral rollers in each channel, each pair including at least first and second rollers spaced apart on either side of an associated channel and mounted for rotation about essentially vertical axis which are essentially perpendicular to the direction of glide beam movement, the lower edge of an associated glide beam receivable between the lateral rollers.

32. The apparatus of claim 27 wherein each guide beam includes a U-shaped beam including two lateral members and a transverse member which traverses the distance between the lateral members, an upwardly facing surface formed by the transverse member.

33. The apparatus of claim 32 wherein the guide beam further includes inner and outer I beams, each I beam including a transverse member and top and bottom members, each I beam transverse member traversing the distance between associated top and bottom members, each U-shaped member lateral member secured to a separate one of the I beam transverse members such that the U-shaped member transverse member traverses the distance between the I beam transverse members, the top surfaces of each of the I beam top members forming glide beam top surfaces.

34. The apparatus of claim 33 wherein the top surfaces of each guide beam include an inner surface between an associated glide beam and the deck and an outer surface on the side of the associated glide beam opposite the deck and wherein the rollers include a separate roller linked to each glide beam for movement along either the inner or the outer surfaces.

35. The apparatus of claim 34 wherein the rollers includes rollers linked to each glide beam for movement along each of the inner and outer surfaces.

36. The apparatus of claim 32 further including, for each guide beam, at least one roller disposed on the upwardly facing surface and arranged about an axis which is perpendicular to the direction of glide beam travel, the rollers supporting the glide beams thereon.

37. The apparatus of claim 36 wherein the at least one roller includes a plurality of rollers essentially equispaced along the upwardly facing surface length.

38. The apparatus of claim 28 further including at least one pair of lateral rollers in each channel, each pair including at least first and second rollers spaced apart on either side of an associated channel and mounted for rotation about essentially vertical axis which are essentially perpendicular to the direction of glide beam movement, the lower edge of an associated glide beam receivable between the lateral rollers.

39. The apparatus of claim 38 wherein the at least one pair includes a plurality of pairs which are essentially equispaced along the channel length.

40. A crane system comprising:

at least first and second crane apparatus, each crane apparatus including:

(a) a carriage including a deck and at least one truck mechanism connected to an undersurface of the deck, the deck including forward and rearward edges and first and second lateral edges;

(b) at least one support member having a distal end, the support member mounted to the deck such that the distal end is laterally extendable from the first edge;

(c) first and second glide beams, the first beam coupled to the distal end for movement along a movement axis parallel to a first beam length, the second beam coupled to the deck so as to be essentially parallel and spaced apart from the first beam and for movement essentially parallel to the movement axis, each of the first and second glide beams includes fore and rear ends;

(d) at least one support beam having first and second ends, the first end coupled to the top of the second apparatus first glide beam and the second end coupled to the top of the second apparatus second glide beam, the support beam having a variable length component perpendicular to the first glide beam length; and the first apparatus further including first couplers at each of the fore ends and the second apparatus further including second couplers at each of the rear ends, the first couplers receivable by the second couplers to secure the fore and rear ends of the first and second apparatus glide beams together, respectively;

wherein the support members are moveable between at least retracted and extended positions, when in the retracted position, the distal ends adjacent the first lateral edges and when in the extended positions, the distal ends separated from the first lateral edges, and, wherein, the fore and rear ends of the first and second apparatus glide beams are securable together and are moveable essentially parallel to the movement axis relative to the carriages such that the first and second apparatus glide beams together can form a truss.

41. A crane apparatus comprising:

(a) a carriage including a deck and at least one truck mechanism connected to an undersurface of the deck, the deck including forward and rearward edges and first and second lateral edges;

(b) first and second vertical lifters, the first vertical lifter coupled to the deck and the second vertical lifter coupled to the deck and spaced apart from the first vertical lifter;

(c) first and second glide beams, the first beam coupled to the first vertical lifter for movement along a movement axis parallel to a first beam length, the second beam coupled to the second vertical lifter so as to be essentially parallel and spaced apart from the first beam and for movement essentially parallel to the movement axis;

(d) at least one support beam having first and second ends, the first end coupled to the top of the first glide beam and the second end coupled to the top of the second glide beam, the support beam having a variable length component perpendicular to the first glide beam length; and (e) at least one tool apparatus linked to the support beam;

(f) wherein the vertical lifters are moveable between at least a retracted position and an extended position, when in the retracted position, the glide beams in a first position relative to the deck and when in an extended position, the glide beams in a second position relative to the deck, in the second position, the glide beams farther above the deck than in the first position, and, wherein, the glide beams are moveable parallel to the movement axis relative to the carriage.

42. The apparatus of claim 41 further including at least one support member having a distal end, the support member mounted to the deck such that the distal end is laterally extendable from the first edge, the first vertical lifter coupled to the deck by being linked to the distal end of the support member, wherein, the support member is moveable between retracted and extended positions, when in the retracted position, the distal end adjacent the first lateral edge and when in the extended position, the distal end separated from the first lateral edge.

43. The apparatus of claim 42 wherein the support member is a first support member and the apparatus further includes a second support member having a distal end and mounted to the deck such that the distal end is laterally extendable from the second edge, the second glide beam coupled to the second support member distal end for movement along the movement axis and, wherein the support member is moveable between a retracted position wherein the distal end of the support member is adjacent the second lateral edge and an extended position wherein the distal end is separated from the second lateral edge.

* * * * *